US010049626B2

(12) United States Patent
Ho et al.

(10) Patent No.: US 10,049,626 B2
(45) Date of Patent: Aug. 14, 2018

(54) PIXEL STRUCTURE

(71) Applicant: AU Optronics Corporation, Hsin-Chu (TW)

(72) Inventors: Sheng-Ju Ho, Hsin-Chu (TW); Meng-Chiou Huang, Hsin-Chu (TW); Chia-Hui Pai, Hsin-Chu (TW); Shang-Jie Wu, Hsin-Chu (TW); Yi-Jung Chen, Hsin-Chu (TW); Hung-Che Lin, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 107 days.

(21) Appl. No.: 15/150,469

(22) Filed: May 10, 2016

(65) Prior Publication Data

US 2017/0193930 A1 Jul. 6, 2017

(30) Foreign Application Priority Data

Jan. 4, 2016 (TW) ..... 105100096 A

(51) Int. Cl.
*G09G 3/36* (2006.01)

(52) U.S. Cl.
CPC ..... *G09G 3/3607* (2013.01); *G09G 3/3674* (2013.01); *G09G 2300/0426* (2013.01); (Continued)

(58) Field of Classification Search
None
See application file for complete search history.

(56) References Cited

U.S. PATENT DOCUMENTS 8,378,350 B2 2/2013 Suzuki et al.
9,007,541 B2 4/2015 Chen et al.
(Continued)

FOREIGN PATENT DOCUMENTS

CN 104483790 A 4/2015
JP 2010156867 A 7/2010

OTHER PUBLICATIONS

TW Office Action dated Aug. 9, 2016 in corresponding Taiwan application (No. 105100096).

*Primary Examiner* — Kumar Patel
*Assistant Examiner* — Amen Bogale
(74) *Attorney, Agent, or Firm* — McClure, Qualey & Rodack, LLP

(57) ABSTRACT

A pixel structure includes a scan line, a data line, first and second common lines, first and second sub-pixels, and a color filter layer. The scan line is disposed between the first and second common lines. The first sub-pixel and the second pixel respectively include an active device and a pixel electrode. The pixel electrode of the first sub-pixel is disposed between the scan line and the first common line. The pixel electrode of the second sub-pixel is disposed between the scan line and the second common line. The pixel electrode is connected to the active device through a contact hole. The pixel electrode includes a first side and a second side opposite to each other, wherein the first side of the pixel electrode is adjacent to the scan line, and the contact hole is disposed at an edge of the pixel electrode adjacent to the second side. The color filter layer has an opening exposing the active devices of the first sub-pixel and the second sub-pixel.

17 Claims, 23 Drawing Sheets

(52) U.S. Cl.
CPC ..... *G09G 2300/0443* (2013.01); *G09G 2300/0452* (2013.01); *G09G 2320/0666* (2013.01)

(56) References Cited

U.S. PATENT DOCUMENTS

| | | | | |
|---|---|---|---|---|
| 2010/0109989 | A1* | 5/2010 | Itsumi | G02F 1/136259 345/87 |
| 2011/0128280 | A1* | 6/2011 | Tseng | G02F 1/133512 345/214 |
| 2014/0118675 | A1* | 5/2014 | Kimura | G02F 1/133707 349/138 |
| 2016/0306246 | A1* | 10/2016 | Kum | G02F 1/13624 |

* cited by examiner

PIXEL STRUCTURE

BACKGROUND

The present application claims priority to Taiwan patent application 105100096, filed Jan. 4, 2016, the contents of which are incorporated herein by reference.

TECHNICAL FIELD

The present invention relates to a pixel structure, and in particular, to a pixel structure adapted to have a small size.

RELATED ART

Along with the development of display technologies, the requirements on the display panel are also developed to become lighter and thinner, having a high picture quality, and saving power. Particularly, in order to achieve a high resolution, it is necessary to deploy more pixels in the same area, so that the size of the pixel is becoming smaller and smaller, and the wiring design of the pixels will be faced with more stringent challenges.

Generally speaking, the manner of providing two common lines having different electric potentials to respectively couple with a storage capacitance of a major sub-pixel region and an auxiliary sub-pixel region in the pixel structure is adopted, such that the major sub-pixel region and the auxiliary sub-pixel region obtain different voltages, so as to improve color washout. However, when the above wiring manner is implemented in connection with a fabricating manner of color Filter on Array (COA), low aperture ratio often results.

SUMMARY

The present invention provides a pixel structure having a high aperture ratio.

The pixel structure of embodiments of the present invention includes a first scan line, a first data line, first second common lines, a first pixel unit, and a color filter layer. The first data line intersects with the first scan line. The first scan line is disposed between the first common line and the second common line, and the first common line and the second common line have different electric potentials. The first pixel unit includes a first sub-pixel and a second sub-pixel. The first sub-pixel includes a first active device and a first pixel electrode. The first active device is electrically connected to the first scan line and the first data line. The first pixel electrode is disposed between the first scan line and the first common line, and is electrically connected to the first active device through a first contact hole, wherein the first pixel electrode includes a first side and a second side opposite to each other, the first side of the first pixel electrode is adjacent to the first scan line, and the first contact hole is disposed at an edge of the first pixel electrode adjacent to the second side. The second sub-pixel includes a second active device and a second pixel electrode. The second active device is electrically connected to the first scan line and the first data line. The second pixel electrode is disposed between the first scan line and the second common line, and is electrically connected to the second active device through a second contact hole, wherein the second pixel electrode includes a first side and a second side opposite to each other, the first side of the second pixel electrode is adjacent to the first scan line, and the second contact hole is disposed at an edge of the second pixel electrode adjacent to the second side. The color filter layer is arranged above the first pixel unit and includes a first opening, so as to not cover a part of the first active device and a part of the second active device.

In an embodiment of the present invention, the above first contact hole is arranged in overlapping fashion with the first common line, and the second contact hole is arranged in overlapping fashion with the second common line.

In an embodiment of the present invention, a shielding pattern layer is further included, which includes shielding pattern blocks, filled into a first opening.

In an embodiment of the present invention, a second data line and a second pixel unit are further included. The second data line intersects with the first scan line. The second pixel unit and the first pixel unit are disposed on the same row. The second pixel unit includes a third sub-pixel and a fourth sub-pixel. The third sub-pixel includes a third active device and a third pixel electrode. The third active device is electrically connected to the first scan line and the second data line. The third pixel electrode is disposed between the first scan line and the first common line, and is electrically connected to the third active device through a third contact hole, wherein the third pixel electrode includes a first side and a second side opposite to each other, the first side of the third pixel electrode is adjacent to the first scan line, and the third contact hole is disposed at an edge of the third pixel electrode adjacent to the second side. The fourth sub-pixel includes a fourth active device and a fourth pixel electrode. The fourth active device is electrically connected to the first scan line and the second data line. The fourth pixel electrode is disposed between the first scan line and the second common line, and is electrically connected to the fourth active device through a fourth contact hole, wherein the fourth pixel electrode includes a first side and a second side opposite to each other, the first side of the fourth pixel electrode is adjacent to the first scan line, and the fourth contact hole is disposed at an edge of the fourth pixel electrode adjacent to the second side. The color filter layer is further arranged above the second pixel unit and includes a second opening, so as to not cover a part of the third active device and a part of the fourth active device.

In an embodiment of the present invention, the above second pixel unit is disposed between the first data line and the second data line, and the first data line is disposed between the first pixel unit and the second pixel unit.

In an embodiment of the present invention, the above third contact hole and the first contact hole are arranged in mirror relative to the first data line, the fourth contact hole and the second contact hole are arranged in mirror relative to the first data line, and a distance between the first contact hole and the third contact hole and the first data line is less than a distance between the second contact hole and the fourth contact hole and the first data line.

In an embodiment of the present invention, the above first opening and the second opening are disposed at two opposite sides of the second data line, and the first opening is separated from the second opening.

In an embodiment of the present invention, the above first opening and the second opening are both adjacent to the second data line, and the first opening is connected to the second opening.

In an embodiment of the present invention, the above first active device and the second active device share a first source, the third active device and the fourth active device share a second source, the length of the second source in the direction of the first scan line is greater than the length of the first source in the direction of the first scan line, and an overlapping part between the first scan line and the second source includes an first scan line opening.

In an embodiment of the present invention, a second scan line, a third common line, and a third pixel unit are further included. The second scan line insects with the first data line, wherein the second common line is disposed between the second scan line and the first scan line. The second scan line is disposed between the second common line and the third common line, and the third common line and the second common line have different electric potentials. The third pixel unit is disposed on the same column as the first pixel unit, and includes a fifth sub-pixel and a sixth sub-pixel. The fifth sub-pixel includes a fifth active device and a fifth pixel electrode. The fifth active device is electrically connected to the second scan line. The fifth pixel electrode is disposed between the second common line and the second scan line, and is electrically connected to the fifth active device through a fifth contact hole, wherein the fifth pixel electrode includes a first side and a second side opposite to each other, the first side of the fifth pixel electrode is adjacent to the second scan line, and the fifth contact hole is disposed at an edge of the fifth pixel electrode adjacent to the second side. The sixth sub-pixel includes a sixth active device and a sixth pixel electrode. The sixth active device is electrically connected to the second scan line. The sixth pixel electrode is disposed between the second scan line and the third common line, and is electrically connected to the sixth active device through a sixth contact hole, wherein the sixth pixel electrode includes a first side and a second side opposite to each other, the first side of the sixth pixel electrode is adjacent to the second scan line, and the sixth contact hole is disposed at an edge of the sixth pixel electrode adjacent to the second side. The color filter layer is further arranged above the third pixel unit, wherein the color filter layer includes a third opening and a trench, the third opening is corresponding to a part of the fifth active device and a part of the sixth active device, and the trench is disposed between the first pixel unit and the third pixel unit and corresponding to the second contact hole and the fifth contact hole.

In an embodiment of the present invention, the above first contact hole is arranged in overlapping fashion with the first common line, the second contact hole and the fifth contact hole are arranged in overlapping fashion with the second common line, and the sixth contact hole is arranged in overlapping fashion with the third common line.

In an embodiment of the present invention, a fourth common line is further included and disposed between the second common line and the second scan line, wherein the third pixel unit is disposed between the fourth common line and the third common line.

In an embodiment of the present invention, the above first contact hole is arranged in overlapping fashion with the first common line, the second contact hole is arranged in overlapping fashion with the second common line, the fifth contact hole is arranged in overlapping fashion with the fourth common line, and the sixth contact hole is arranged in overlapping fashion with the third common line.

In an embodiment of the present invention, a second scan line, a third common line, a third pixel unit, and a fourth pixel unit are further included. The second scan line insects with the first data line and the second data line, wherein the second common line is disposed between the second scan line and the first scan line. The second scan line is disposed between the second common line and the third common line, and the third common line and the second common line have different electric potentials. The third pixel unit is disposed in the same column as the first pixel unit. The third pixel unit includes a fifth sub-pixel and a sixth sub-pixel. The fifth active device is electrically connected to the second scan line. The fifth pixel electrode is disposed between the second common line and the second scan line, and is electrically connected to the fifth active device through the fifth contact hole, wherein the fifth contact hole is disposed at an edge of the fifth pixel electrode. The sixth sub-pixel includes a sixth active device and a sixth pixel electrode. The sixth active device is electrically connected to the second scan line. The sixth pixel electrode is disposed between the second scan line and the third common line, and is electrically connected to the sixth active device through a sixth contact hole, wherein the sixth pixel electrode includes a first side and a second side opposite to each other, the first side of the sixth pixel electrode is adjacent to the second scan line, and the sixth contact hole is disposed at an edge of the sixth pixel electrode adjacent to the second side. The fourth pixel unit is disposed on the same column as the second pixel unit and is disposed on the same row as the third pixel unit. The fourth pixel unit includes a seventh sub-pixel and an eighth sub-pixel. The seventh sub-pixel includes a seventh active device and a seventh pixel electrode. The seventh active device is electrically connected to the second scan line. The seventh pixel electrode is disposed between the second scan line and the second common line, and is electrically connected to the seventh active device through the seventh contact hole, wherein the seventh contact hole is disposed at an edge of the seventh pixel electrode. The eighth sub-pixel includes an eighth active device and an eighth pixel electrode. The eighth active device is electrically connected to the second scan line. The eighth pixel electrode is disposed between the second scan line and the third common line, and is electrically connected to the eighth active device through an eighth contact hole, wherein the eighth pixel electrode includes a first side and a second side opposite to each other, the first side of the eighth pixel electrode is adjacent to the second scan line, and the eighth contact hole is disposed at an edge of the eighth pixel electrode adjacent to the second side.

The color filter layer is further arranged above the third pixel unit and the fourth pixel unit, wherein the color filter layer includes a third opening, a fourth opening, and a trench, the third opening is corresponding to a part of the fifth active device and a part of the sixth active device, the fourth opening is corresponding to a part of the seventh active device and a part of the eighth active device, and the second contact hole, a fourth contact hole, a fifth contact hole, and a seventh contact hole are disposed in the trench.

In an embodiment of the present invention, the above fifth active device and the sixth active device are electrically connected to the first data line, and the seventh active device and the eighth active device are electrically connected to the second data line.

In an embodiment of the present invention, the above second and fourth pixel units are disposed between the first data line and the second data line, the first data line is disposed between the first and second pixel units and between third and fourth pixel units, the third active device and the fourth active device share a second source, the overlapping part between the first scan line and the second source is provided with a first scan line opening, the fifth active device and the sixth active device share a third source, and the overlapping part between the second scan line and the third source is provided with a second scan line opening.

In an embodiment of the present invention, a third data line is further included, wherein the fifth and sixth active devices are electrically connected to the second data line, and the seventh and eighth active devices are electrically connected to the third data line.

In an embodiment of the present invention, the above first opening is separated from the second opening, the third opening is connected to the fourth opening, and the third opening is separated from the fourth opening.

In an embodiment of the present invention, the above first contact hole and the third contact hole are arranged in mirror relative to the first data line, the second contact hole and the fourth contact hole are arranged in mirror relative to the first data line, the fifth contact hole and the seventh contact hole are arranged in mirror relative to the first data line, the sixth contact hole and the eighth contact hole are arranged in mirror relative to the first data line, a distance between the first contact hole and the third contact hole is less than a distance between the second contact hole and the fourth contact hole, and a distance between the fifth contact hole and the seventh contact hole is less than a distance between the sixth contact hole and the eighth contact hole.

In an embodiment of the present invention, the above first contact hole and the third contact hole are arranged in overlapping fashion with the first common line, the second contact hole, the fourth contact hole, the fifth contact hole, and the seventh contact hole are arranged in overlapping fashion with the second common line, and the sixth contact hole and the eighth contact hole are arranged in overlapping fashion with the third common line.

In an embodiment of the present invention, a fourth common line is further included and disposed between the second common line and the second scan line, wherein the third pixel unit and the fourth pixel unit are disposed between the fourth common line and the third common line.

In an embodiment of the present invention, the above first contact hole and the third contact hole are arranged in overlapping fashion with the first common line, the second contact hole and the fourth contact hole are arranged in overlapping fashion with the second common line, the fifth contact hole and the seventh contact hole are arranged in overlapping fashion with the fourth common line, and the sixth contact hole and the eighth contact hole are arranged in overlapping fashion with the third common line.

In an embodiment of the present invention, an opposite electrode and a display medium layer are further included, wherein the display medium layer are arranged between the first and second pixel electrode and the opposite electrode, the first pixel electrode includes at least two alignment domains, and the second pixel electrode includes at least two alignment domains.

In view of the above, in the pixel structure of embodiments of the present invention, the contact hole is arranged at an edge of the pixel electrode adjacent to the common line, such that the contact holes of two sub-pixels are disposed at two sides opposing each other. Further, the active devices of two adjacent pixel units on the same row are arranged adjacent to each other, the openings of the color filter layer for exposing the active devices can be connected to each other, so that the shielding pattern blocks filled in the openings have a larger volume. In this way, the problem that the shielding pattern blocks are prone to strip off due to an overly small volume can be avoided, such that the pixel structure has a preferred yield.

Embodiments of the present invention, accompanied with figures, are described in detail below.

DETAILED DESCRIPTION

Figure 1A:
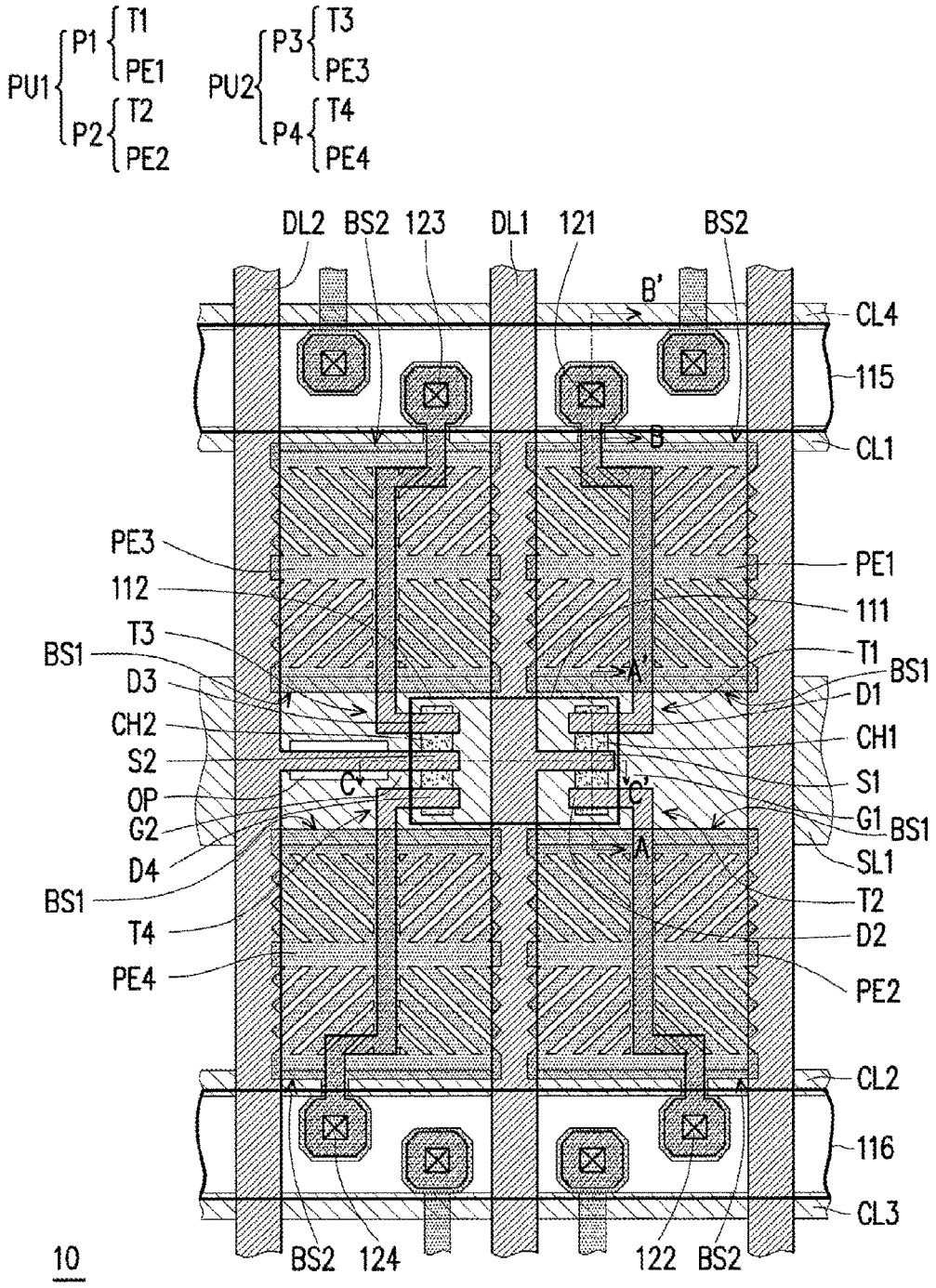
FIG. 1A is a schematic view of a pixel structure according to an embodiment of the present invention.
Figure 1B:
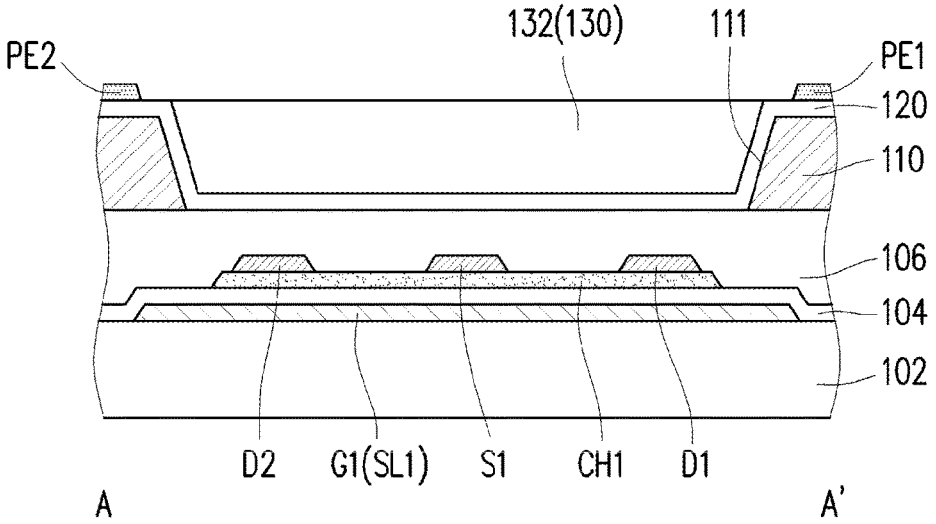
FIG. 1B to FIG. 1D are respectively schematic cross-sectional views along the lines A-A', B-B', and C-C' in FIG. 1A.
Figure 1C:
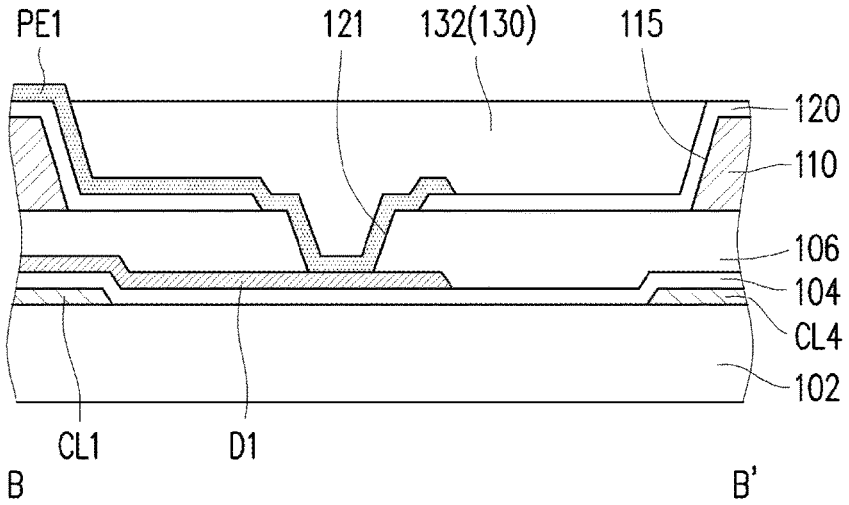
Figure 1D:
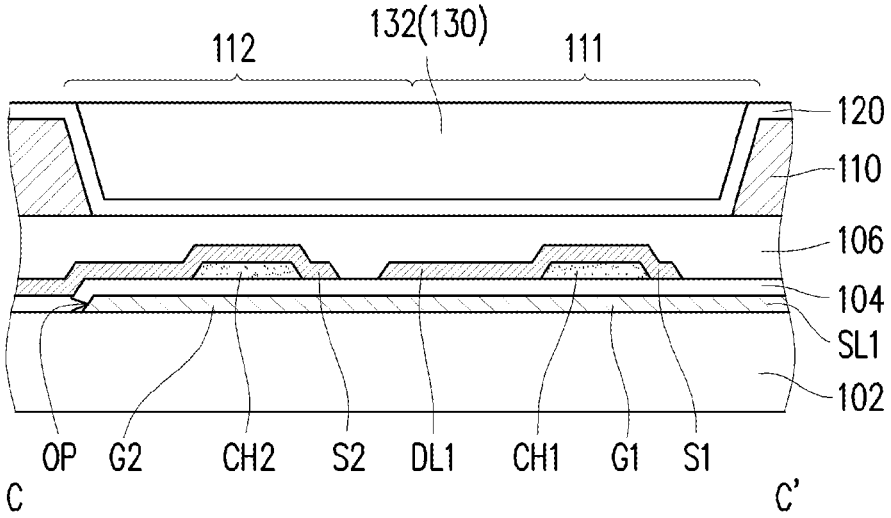

FIG. 1A is a schematic view of a pixel structure according to an embodiment of the present invention. FIG. 1B to FIG. 1D are respectively schematic cross-sectional views along the lines A-A', B-B', and C-C' in FIG. 1A. With reference to FIG. 1A to FIG. 1D altogether, a pixel structure 10 includes a first scan line SL1, a first data line DL1, a first common line CL1, a second common line CL2, a first pixel unit PU1, a color filter layer 110, and a shielding pattern layer 130 arranged on a substrate 102. The first data line DL1 intersects with the first scan line SL1. The first scan line SL1 is disposed between the first common line CL1 and the second common line CL2.

The first pixel unit PU1 includes a first sub-pixel P1 and a second sub-pixel P2. The first sub-pixel P1 includes a first active device T1 and a first pixel electrode PE1. The first active device T1 is electrically connected to the first scan line SL1 and the first data line DL1. The first pixel electrode PE1 is electrically connected to the first active device T1 through a first contact hole 121, the first pixel electrode PE1 is disposed between the first scan line SL1 and the first common line CL1, wherein the first contact hole 121 is disposed at an edge of the first pixel electrode PE1 adjacent to the first common line CL1. In this embodiment, the first pixel electrode PE1 includes a first side BS1 and a second side BS2 opposite to each other, the first side BS1 of the first pixel electrode PE1 is adjacent to the first scan line SL1, and the first contact hole 121 is disposed at an edge of the first pixel electrode PE1 adjacent to the second side BS2.

The second sub-pixel P2 includes a second active device T2 and a second pixel electrode PE2. The second active device T2 is electrically connected to the first scan line SL1 and the first data line DL1. The second pixel electrode PE2 is electrically connected to the second active device T2 through a second contact hole 122, the second pixel electrode PE2 is disposed between the first scan line SL1 and the second common line CL2, wherein the second contact hole 122 is disposed at an edge of the second pixel electrode PE2 adjacent to the second common line CL2. In this embodiment, the second pixel electrode PE2 includes a first side BS1 and a second side BS2 opposite to each other, the first side BS1 of the second pixel electrode PE2 is adjacent to the first scan line SL1, and the second contact hole 122 is disposed at an edge of the first pixel electrode PE1 adjacent to the second side BS2.

In this embodiment, the first active device T1 and the second active device T2 for example share the first source S1, the first gate G1, and the first semiconductor layer CH1, the first source S1 is electrically connected to the first data line DL1, and the first gate G1 is electrically connected to the first scan line SL1. The first active device T1 further includes a first drain D1 electrically connected to the first data line DL1, and the first pixel electrode PE1 is electrically connected to the first drain D1 through the first contact hole 121. The second active device T2 further includes a second drain D2 electrically connected to the first data line DL1, and the second pixel electrode PE2 is electrically connected to the second drain D2 through the second contact hole 122.

In this embodiment, the first gate insulation layer 104 for example covers the first gate G1. The first semiconductor layer CH1 is for example arranged on the first gate insulation layer 104. The first source S1 and the first drain D1 are for example disposed on opposite sides of the first gate G1, and the first source S1 and the second drain D2 are for example disposed on opposite sides of the first gate G1. In this embodiment, the first protective layer 106 for example covers the first and second active devices T1 and T2. The color filter layer 110 is for example disposed on the first protective layer 106. In this embodiment, the second protective layer 120 for example covers the color filter layer 110. The first and second contact holes 121 and 122 are for example formed in the first and second protective layers 106 and 120, to expose the first and second drains D1 and D2. The first and second pixel electrodes PE1 and PE2 are for example disposed on the second protective layer 120 and are respectively electrically connected to the first and second drains D1 and D2 through the first and second contact holes 121 and 122.

In this embodiment, the first drain D1 and the second drain D2 for example have a strip-shaped pattern, the first drain D1 extends from one side of the first pixel electrode PE1 adjacent to the first source S1 to one side adjacent to the first common line CL1, and the second drain D2 extends from one side of the second pixel electrode PE2 adjacent to the first source S1 to one side adjacent to the second common line CL2. That is, the first drain D1 for example extends between the first side BS1 and the second side BS2 opposite to each other of the first pixel electrode PEL and the second drain D2 for example extends between the first side BS1 and the second side BS2 opposite to each other of the second pixel electrode PE2. In this embodiment, the first active device T1 and the second active device T2 are altogether arranged in a region adjacent to the first scan line SL1, and the first contact hole 121 and the second contact hole 122 are respectively arranged in a region far away from the first scan line SL1.

In this embodiment, the first common line CL1 and the second common line CL2 have different electric potentials, and after the first common line CL1 and the second common line CL2 are respectively coupled with the storage capacitances of the first sub-pixel P1 and the second sub-pixel P2, the first pixel electrode PE1 and the second pixel electrode PE2 have different electric potentials, thereby color washout is improved.

In this embodiment, the pixel structure 10 for example further includes a second data line DL2 and a second pixel unit PU2. The second data line DL2 intersects with the first scan line SL1, and is parallel to the first data line DL1. In this embodiment, the second pixel unit is for example disposed between the first data line DL1 and the second data line DL2, and the first data line DL1 is for example disposed between the first pixel unit PU1 and the second pixel unit PU2.

The second pixel unit PU2 is disposed on the same row as the first pixel unit PU1, and a member of the second pixel unit PU2 is for example substantially the same as a member of the first pixel unit PU1. In this embodiment, the first pixel unit PU1 and the second pixel unit PU2 are arranged along the extending direction of the first scan line SL1. The second pixel unit PU2 includes a third sub-pixel P3 and a fourth sub-pixel P4. The third sub-pixel P3 includes a third active device T3 and a third pixel electrode PE3. The third active device T3 is electrically connected to the first scan line SL1 and the second data line DL2. The third pixel electrode PE3 is electrically connected to the third active device T3 through a third contact hole 123, the third pixel electrode PE3 is disposed between the first scan line SL1 and the first common line CL1, wherein the third contact hole 123 is disposed at an edge of the third pixel electrode PE3 adjacent to the first common line CL1. In this embodiment, the third pixel electrode PE3 includes a first side BS1 and a second side BS2 opposite to each other, the first side BS1 of the third pixel electrode PE3 is adjacent to the first scan line SL1, and the third contact hole 123 is disposed at an edge of the third pixel electrode PE3 adjacent to the second side BS2. The fourth sub-pixel P4 includes a fourth active device T4 and a fourth pixel electrode PE4. The fourth active device T4 is electrically connected to the first scan line SL1 and the second data line DL2. The fourth pixel electrode PE4 is electrically connected to the fourth active device T4 through a fourth contact hole 124, the fourth pixel electrode PE4 is disposed between the first scan line SL1 and the second common line CL2, wherein an opening of the fourth contact window 124 is disposed at an edge of the fourth pixel electrode PE4 adjacent to the second common line CL2. In this embodiment, the fourth pixel electrode PE4 includes a first side BS1 and a second side BS2 opposite to each other, the first side BS1 of the fourth pixel electrode PE4 is adjacent to the first scan line SL1, and the fourth contact hole 124 is disposed at an edge of the fourth pixel electrode PE4 adjacent to the second side BS2.

In this embodiment, the third and fourth active devices T3 and T4 for example share a second source S2, a second gate G2, and a second semiconductor layer CH2, the second source S2 is electrically connected to the second data line DL2, and the second gate G2 is electrically connected to the first scan line SL1. The third active device T3 further includes a third drain D3 electrically connected to the second data line DL2, and the third pixel electrode PE3 is electrically connected to the third drain D3 through the third contact hole 123. The fourth active device T4 further includes a fourth drain D4 electrically connected to the second data line DL2, and the fourth pixel electrode PE4 is electrically connected to the fourth drain D4 through the fourth contact hole 124.

In this embodiment, the first to fourth active devices T1-T4 are for example all disposed at an intersection part between the first data line DL1 and the first scan line SL1. In this embodiment, the first data line DL1 and the second data line DL2 for example give signals to the first pixel unit PU1 and the second pixel unit PU2 from the same side. The first source S1 and the second source S2 for example extend from the same side of the first data line DL1 and the second data line DL2 respectively, wherein a distance of the second source S2 extending on the first scan line SL1 is greater than a distance of the first source S1 extending on the first scan line SL1. That is, the first source S1 and the second source S2 extend along the direction of the first scan line SL1, and a length of the second source S2 along the direction of the first scan line SL1 is greater than a length of the first source S1 along the first scan line SL1. In order to make the first source S1 and the second source S2 respectively have substantially the same capacitance value as the first gate G1 and the second gate G2 below the first source S1 and the second source S2, and an overlapping part between the first scan line SL1 and the second source S2 has a scan line opening OP.

In this embodiment, the third contact hole 123 and the first contact hole 121 are for example arranged in mirror relative to the first data line DL1, the fourth contact hole 124 and the second contact hole 122 are for example arranged in mirror relative to the first data line DL1, a distance between the first contact hole 121 and the third contact hole 123 respectively and the first data line DL1 is less than a distance between the second contact hole 122 and the fourth contact hole 124 respectively and the first data line DL1. That is, a distance between the first contact hole 121 and the first data line DL1 (or a distance between the third contact hole 123 and the first data line DL1) is less than a distance between the second contact hole 122 and the first data line DL1 (or a distance between the fourth contact hole 124 and the first data line DL1).

The color filter layer 110 is disposed above the first and two pixel units PU1 and PU2. The color filter layer 110 includes a first opening 111 exposing a part of the first and second active devices T1 and T2. In this embodiment, at least a part of the first and second active devices T1 and T2 are not covered by the color filter layer 110, and the first opening 111 is overlapped with a part of the first and second active devices T1 and T2 in the orthogonal projection direction (also known as Z direction of the substrate 102). The first opening 111 is for example disposed above the first scan line SL1, for exposing the source S1, the gate G1, the semiconductor layer CH1, a part of the first drain D1 and a part of the second drain D2. In this embodiment, the color filter layer 110 further includes a second opening 112, exposing a part of third and fourth active devices T3 and T4. In this embodiment, at least a part of third and fourth active devices T3 and T4 are not covered by the color filter layer 110, and the second opening 112 is overlapped with a part of third and fourth active devices T3 and T4 in the orthogonal projection direction. The first opening 111 and the second opening 112 are disposed on two opposite sides of the first data line DL1. In this embodiment, the first opening 111 and the second opening 112 are for example both adjacent to the first data line DL1, and the first opening 111 and the second opening 112 are connected to each other.

In this embodiment, the color filter layer 110 for example further includes a first trench 115 and a second trench 116, the first trench 115 exposes the first contact hole 121 and the third contact hole 123, and the second trench 116 exposes the second contact hole 122 and the fourth contact hole 124. That is, the first contact hole 121 and the third contact hole 123 are disposed in the first trench 115, and the second contact hole 122 and the fourth contact hole 124 are disposed in the second trench 116.

In this embodiment, the shielding pattern layer 130 includes a plurality of shielding pattern blocks 132, respectively filled into the first opening 111, the second opening 112, the first trench 115, and the second trench 116. In this embodiment, since the first opening 111 and the second opening 112 are connected to each other, the filled shielding pattern blocks 132 have a larger volume. Furthermore, the first trench 115 and the second trench 116 are respectively continuous extension structures, so that the filled shielding pattern blocks 132 also have a larger volume.

In this embodiment, by feeding signals into the first and second pixel units PU1 and PU2 from the same side of the first and second data lines DL1 and DL2, a scan line opening OP is formed in the second gate G2 below the second source S2, such that the first and second active devices T1 and T2 of the first and second pixel units PU1 and PU2 are altogether disposed at two sides of the second data line DL1, and a capacitance value between the first source S1 and the first gate G1 is substantially the same as a capacitance value between the second source S2 and the second gate G2. In this way, the first and second openings 111 and 112 for exposing a part of the first and second active devices T1 and T2 can be arranged to be connected to each other, and the shielding pattern blocks 132 filled into the first and second openings 111 and 112 have a larger volume, so as to be firmly disposed, thereby avoiding the problem that the shielding pattern blocks 132 are prone to strip off due to a small volume in the fabricating process. Further, the shielding pattern blocks 132 disposed at the intersecting part between the first scan line SL1 and the second data line DL2 may be used as spacers, so that additional process and space for arranging the spacers.

Figure 2A:
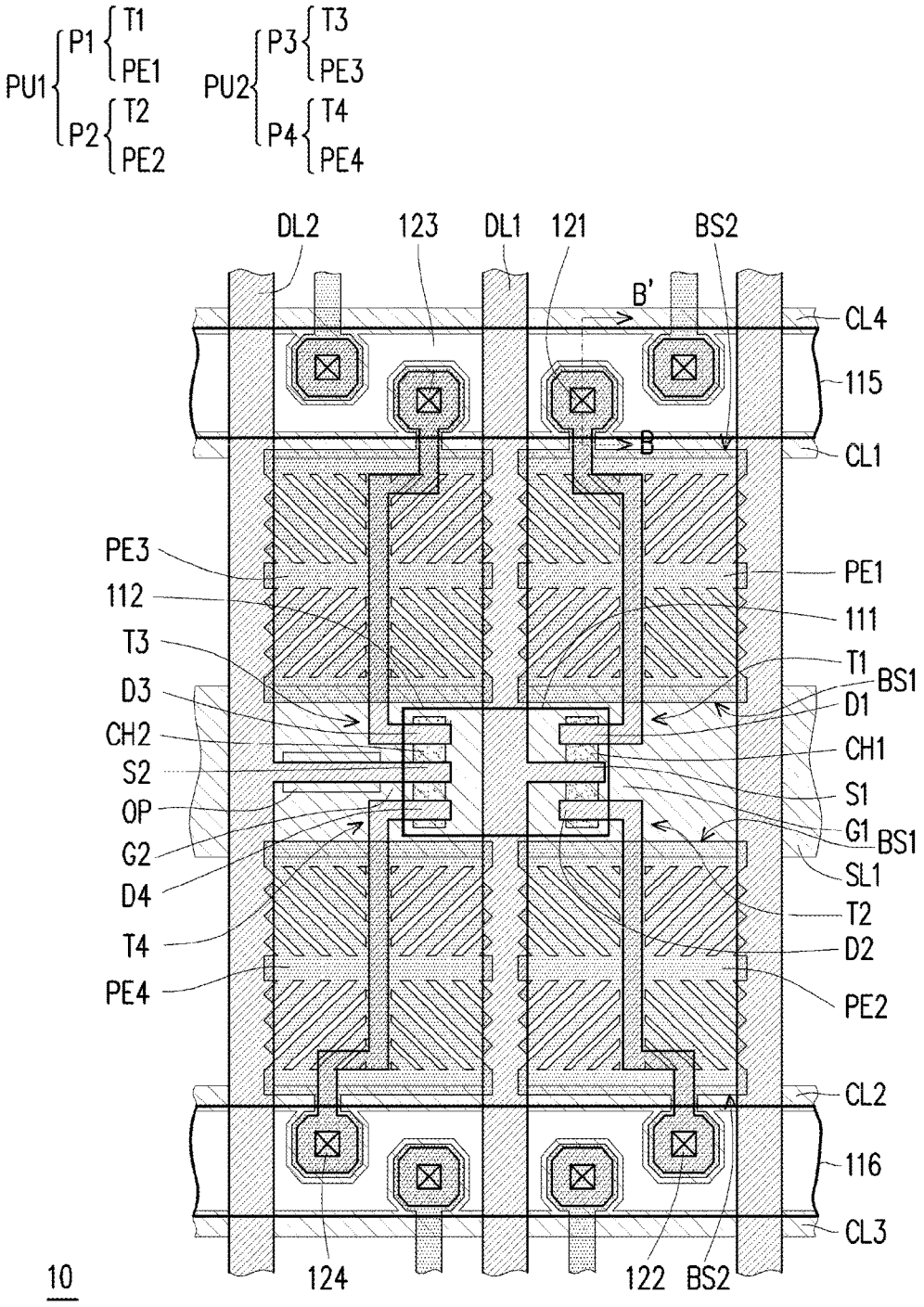
FIG. 2A is a schematic view of a pixel structure according to an embodiment of the present invention.
Figure 2B:
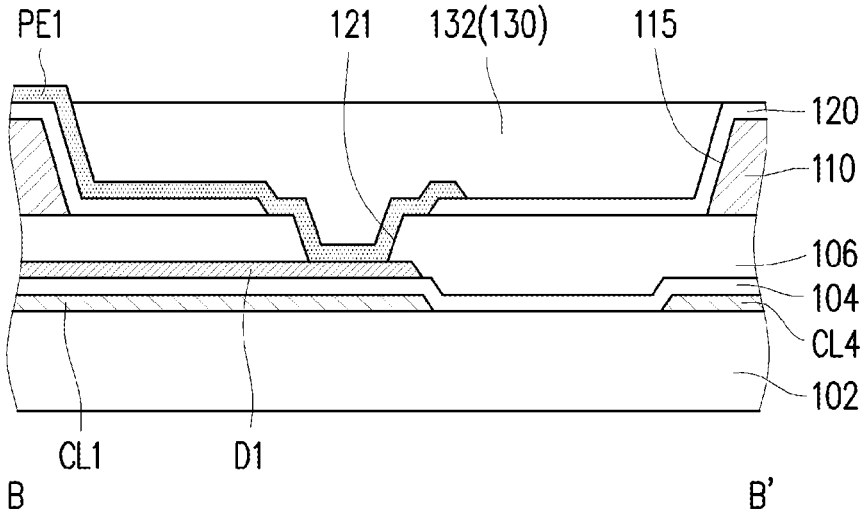
FIG. 2B is a schematic cross-sectional view along the line B-B' in FIG. 2A.

FIG. 2A is a schematic view of a pixel structure according to an embodiment of the present invention, and FIG. 2B is a schematic cross-sectional view along the line B-B' in FIG. 2B. The members of the pixel structure in FIG. 2A are substantially the same as the members of the pixel structure in FIG. 1A, so the following merely gives illustration on the difference therebetween. With reference to FIG. 2A and FIG. 2B altogether, in this embodiment, the first contact hole 121 and the first common line CL1 are for example arranged in overlapping fashion with each other, and the second contact hole 122 and the second common line CL2 are for example arranged in overlapping fashion with each other. That is, in this embodiment, the first common line CL1 for example extends to a part below the first contact hole 121, i.e., the overlapping part between the first drain D1 and the first pixel electrode PE1, so as to form a capacitance with the first drain D1. The second common line CL2 for example extends to a part below the second contact hole 122, i.e., the overlapping part between the second drain D2 and the second pixel electrode PE2, so as to form a capacitance with the second drain D2. Similarly, the third contact hole 123 is for example arranged in overlapping fashion with the first common line CL1, and the fourth contact hole 124 is for example arranged in overlapping fashion with the second common line CL2.

Figure 3:
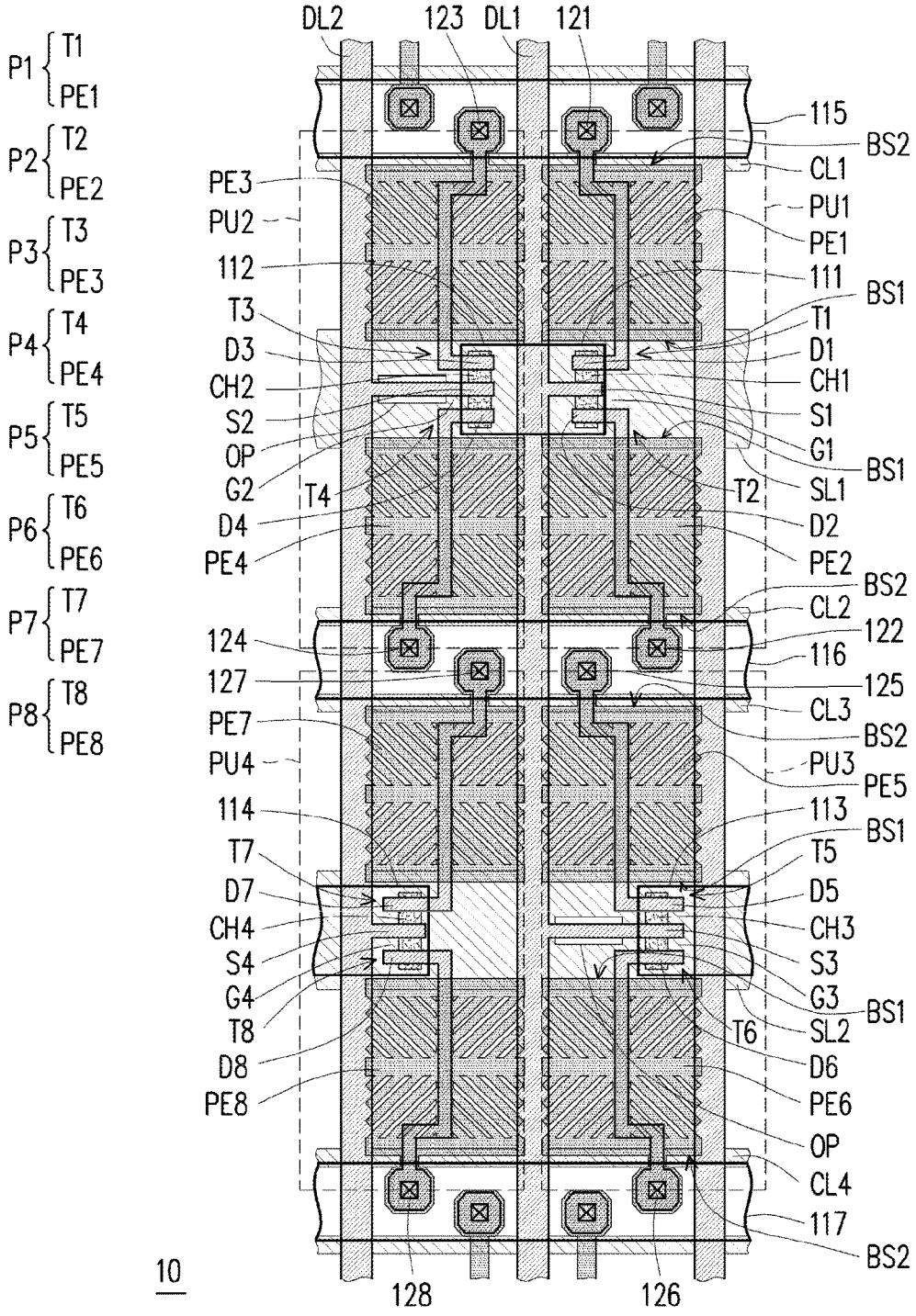
FIG. 3 is a schematic view of a pixel structure according to an embodiment of the present invention.

In general, the pixel structure includes a pixel unit in which a plurality of arrays are arranged, so that the pixel structure is further illustrated by taking the following four pixel units as basic units. FIG. 3 is a schematic view of a pixel structure according to an embodiment of the present invention. With reference to FIG. 3, in this embodiment, the pixel structure 10 for example further includes a second scan line SL2, third and fourth common lines CL3 and CL4, and third and fourth pixel units PU3 and PU4. The second scan line SL2 intersects with the first and second data lines DL1 and DL2, and is parallel to the first scan line SL1. In this embodiment, the second common line CL2 and the third common line CL3 are for example disposed between the first scan line SL1 and the second scan line SL2, and are disposed between the first and third pixel units PU1 and PU3. The third common line CL3 is disposed between the second common line CL2 and the second scan line SL2, and the second scan line SL2 is disposed between the third common line CL3 and the fourth common line CL4. The third common line CL3 and the fourth common line CL4 have different electric potentials.

The third pixel unit PU3 is disposed on the same column as the first pixel unit PU1, and includes a fifth sub-pixel P5 and a sixth sub-pixel P6. In this embodiment, the first pixel unit PU1 and the third pixel unit PU3 are arranged along the extending direction of the first data line DL1. The fifth sub-pixel P5 includes a fifth active device T5 and a fifth pixel electrode PE5. The fifth active device T5 is for example electrically connected to the second scan line SL2 and the first data line DL1. The fifth pixel electrode PE5 is electrically connected to the fifth active device T5 through a fifth contact hole 125, the fifth pixel electrode PE5 is disposed between the third common line CL3 and the second scan line SL2, wherein the fifth contact hole 125 is disposed at an edge of the fifth pixel electrode PE5 adjacent to the third common line CL3. In this embodiment, the fifth pixel electrode PE5 includes a first side BS1 and a second side BS2 opposite to each other, the first side BS1 of the fifth pixel electrode PE5 is adjacent to the second scan line SL2, and the fifth contact hole 125 is disposed at an edge of the fifth pixel electrode PE5 adjacent to the second side BS2. The sixth sub-pixel P6 includes a sixth active device T6 and a sixth pixel electrode PE6. The sixth active device T6 is for example electrically connected to the second scan line SL2 and the first data line DL1. The sixth pixel electrode PE6 is electrically connected to the sixth contact hole 126 and the sixth active device T6, the sixth pixel electrode PE6 is disposed between the second scan line SL2 and the fourth common line CL4, wherein the sixth contact hole 126 is disposed at an edge of the sixth pixel electrode PE6 adjacent to the fourth common line CL4. In this embodiment, the sixth pixel electrode PE6 includes a first side BS1 and a second side BS2 opposite to each other, the first side BS1 of the sixth pixel electrode PE6 is adjacent to the second scan line SL2, and the sixth contact hole 126 is disposed at an edge of the sixth pixel electrode PE6 adjacent to the second side BS2. In this embodiment, the fifth and sixth active devices T5 and T6 for example share a third source S3, a third gate G3, and a third semiconductor layer CH3, and respectively include fifth and sixth drains D5 and D6. In this embodiment, the first contact hole 121 and the first common line CL1 are for example arranged in overlapping fashion with each other, the second contact hole 122 and the second common line CL2 are for example arranged in overlapping fashion with each other, the fifth contact hole 125 and the third common line CL3 are for example arranged in overlapping fashion with each other, and the sixth contact hole 126 are for example arranged in overlapping fashion with the fourth common line CL4.

The fourth pixel unit PU4 is for example disposed on the same column as the second pixel unit PU2 and is disposed on the same row as the third pixel unit PU3. In this embodiment, the fourth pixel unit PU4 and the second pixel unit PU2 are arranged along the extending direction of the second data line DL2, and the fourth pixel unit PU4 and the third pixel unit PU3 are arranged along the extending direction of the second scan line SL2. The fourth pixel unit PU4 includes a seventh sub-pixel P7 and an eighth sub-pixel P8. The seventh sub-pixel P7 includes a seventh active device T7 and a seventh pixel electrode PE7. The seventh active device T7 is for example electrically connected to the second scan line SL2 and the second data line DL2. The seventh pixel electrode PE7 is electrically connected to the seventh active device T7 through a seventh contact hole 127, the seventh pixel electrode PE7 is disposed between the second scan line SL2 and the third common line CL3, wherein the seventh contact hole 127 is disposed at an edge of the seventh pixel electrode PE7 adjacent to the third common line CL3. In this embodiment, the seventh pixel electrode PE7 includes a first side BS1 and a second side BS2 opposite to each other, the first side BS1 of the seventh pixel electrode PE7 is adjacent to the second scan line SL2, and the seventh contact hole 127 is disposed at an edge of the seventh pixel electrode PE7 adjacent to the second side BS2. The eighth sub-pixel P8 includes an eighth active device T8 and an eighth pixel electrode PE8. The eighth active device T8 is for example electrically connected to the second scan line SL2 and the second data line DL2. The eighth pixel electrode PE8 is electrically connected to the eighth active device T8 through an eighth contact hole 128, the eighth pixel electrode PE8 is for example disposed between the second scan line SL2 and the fourth common line CL4, wherein the eighth contact hole 128 is disposed at an edge of the eighth pixel electrode PE8 adjacent to the fourth common line CL4. In this embodiment, the eighth pixel electrode PE8 includes a first side BS1 and a second side BS2 opposite to each other, the first side BS1 of the eighth pixel electrode PE8 is adjacent to the second scan line SL2, and the eighth contact hole 128 is disposed at an edge of the eighth pixel electrode PE8 adjacent to the second side BS2. In this embodiment, the seventh and eighth active devices T7 and T8 for example share a fourth source S4, a fourth gate G4, and a fourth semiconductor layer CH4, and respectively include seventh and eighth drains D7 and D8. In this embodiment, the first contact hole 121 and the third contact hole 123 are for example arranged in overlapping fashion with the first common line CL1, the second contact hole 122 and the fourth contact hole 124 are for example arranged in overlapping fashion with the second common line CL2, the fifth contact hole 125 and the seventh contact hole 127 are for example arranged in overlapping fashion with the third common line CL3, and the sixth contact hole 126 and the eighth contact hole 128 are for example arranged in overlapping fashion with the fourth common line CL4. In this embodiment, the third source S3 and the fourth source S4 extend along the direction of the second scan line SL2, and a length of the third source S3 along the direction of the second scan line SL2 is greater than a length of the fourth source S4 along the direction of the second scan line SL2. In order to make the third source S3 and the fourth source S4 respectively have substantially the same capacitance value as the third gate G3 and the fourth gate G4 below the third source S3 and the fourth source S4, and an overlapping part between the second scan line SL2 and the third source S3 has a scan line opening OP.

In this embodiment, the color filter layer 110 for example further includes a third opening 113 and a fourth opening 114, the third opening 113 exposes a part of the fifth active device T5 and a part of the sixth active device T6, and the fourth opening 114 exposes a part of the seventh active device T7 and a part of the eighth active device T8. That is, the third opening 113 is overlapped with a part of the fifth active device T5 and a part of the sixth active device T6 in the orthogonal projection direction, and the fourth opening 114 is overlapped with a part of the seventh active device T7 and a part of the eighth active device T8 in the orthogonal projection direction. In this embodiment, the third opening 113 and the fourth opening 114 are for example separated from each other and are respectively far away from the first data line DL1. However, the third opening 113 corresponding to the third pixel unit PU3 can be connected to an opening corresponding to a pixel unit adjacent to the third pixel unit PU3 and disposed on the same row. Similarly, the fourth opening 114 corresponding to the fourth pixel unit PU4 can be connected to an opening corresponding to a pixel unit adjacent to the fourth pixel unit PU4 and disposed on the same row. Further, in another embodiment (not shown), the first opening 111 and the third opening 113 may be both far away from the first data line DL1, and the second opening 112 and the fourth opening 114 are both adjacent to the second data line DL2. That is, the first to fourth openings 111-114 are respectively disposed on an edge of the pixel structure.

In this embodiment, the fifth contact hole 125 is for example adjacent to the second contact hole 122, the seventh contact hole 127 is for example adjacent to the fourth contact hole 124, and is for example disposed between the second and third common lines CL2 and CL3. In this embodiment, the second trench 116 for example further exposes the fifth and seventh contact holes 125 and 127. That is, the second trench 116 for example extends to be arranged between the first and third pixel units PU1 and PU3, and between the second and fourth pixel units PU2 and PU4, and the second, fourth, fifth, and seventh contact holes 122, 124, 125, and 127 are disposed in the second trench 116. In this embodiment, the color filter layer 110 for example further includes a third trench 117, for exposing the sixth and eighth contact holes 126 and 128 at the same time. That is, the sixth and eighth contact holes 126 and 128 are disposed in the third trench 117.

Figure 4:
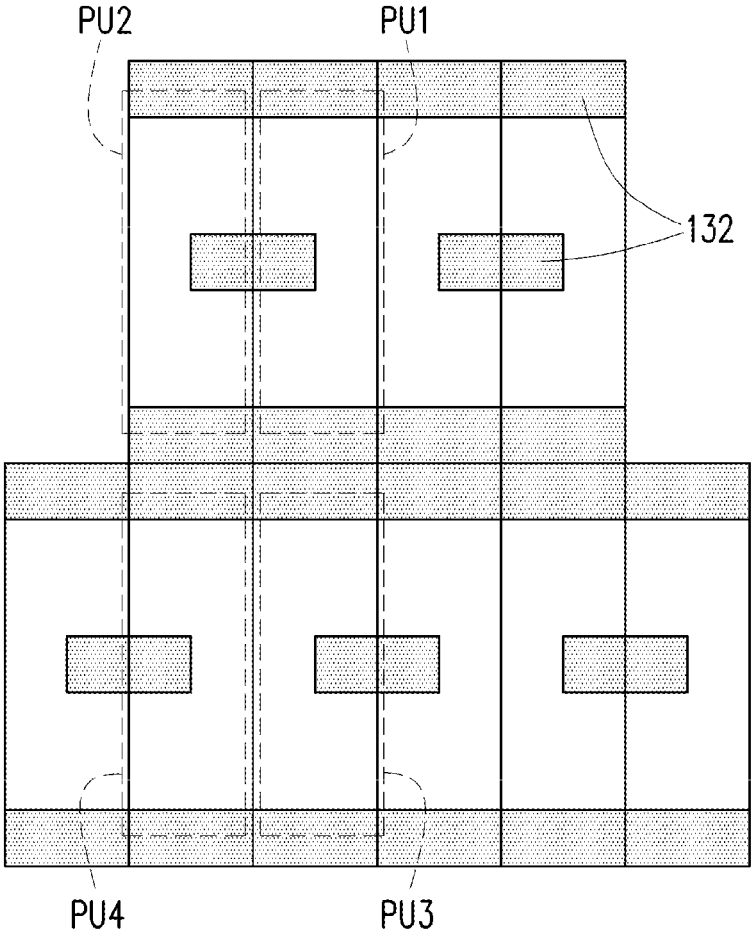
FIG. 4 is a schematic view of an arrangement relationship between shielding pattern blocks and a pixel unit of a pixel structure according to an embodiment of the present invention.

In this embodiment, the openings 111-114 of the color filter layer 110 are for example continuously formed between two adjacent pixel units on the same row, and the trenches 115-117 of the color filter layer 110 are continuously formed between two adjacent pixel units on the same column. In this way, as shown in FIG. 4, the shielding pattern blocks 132 filled into the openings 111-114 and the trenches 115-117 may have a larger volume, so as to avoid the problem that the shielding pattern blocks 132 are prone to strip off due to a small volume in the fabricating process.

Figure 5:
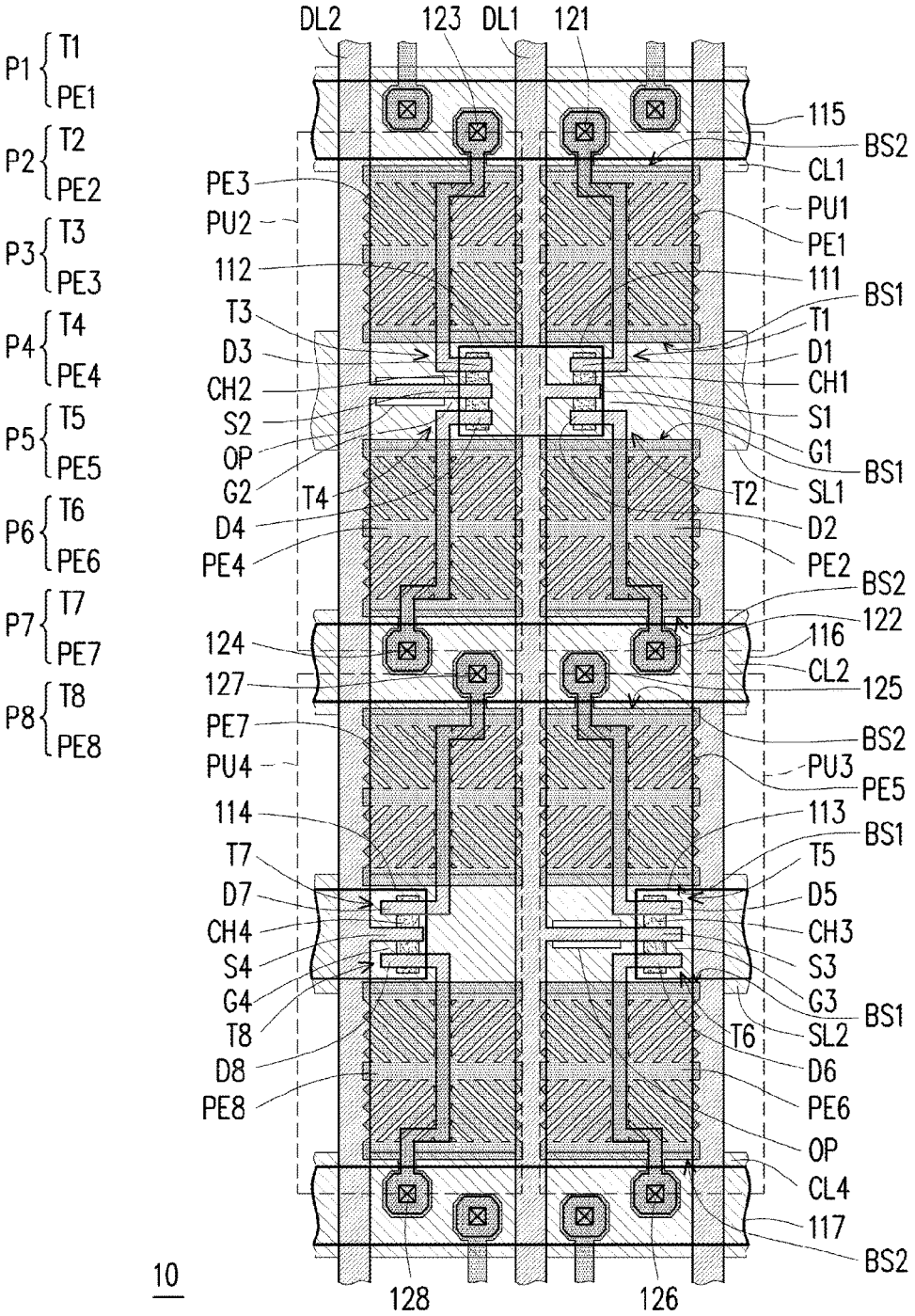
FIG. 5 is a schematic view of a pixel structure according to an embodiment of the present invention.

FIG. 5 is a schematic view of a pixel structure according to an embodiment of the present invention. The members of the pixel structure in FIG. 5 are substantially the same as the members of the pixel structure in FIG. 3, so the following merely gives illustration on the difference therebetween. With reference to FIG. 5, in this embodiment, merely one second common line CL2 is for example arranged between the first and third pixel units PU1 and PU3, and between the second and fourth pixel units PU2 and PU4. That is, in this embodiment, the arrangement of the third common line CL3 can be omitted. In this embodiment, the second common line CL2 is for example arranged in overlapping fashion with the second contact hole 122, the fourth contact hole 124, the fifth contact hole 125, and the seventh contact hole 127.

Figure 6A:
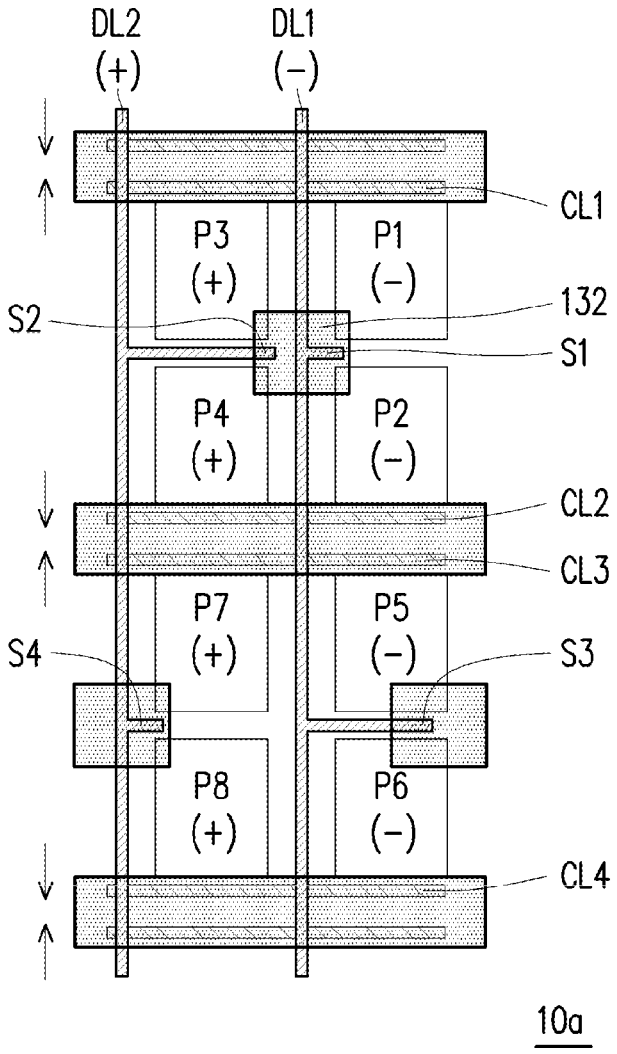
FIG. 6A to FIG. 6N are respectively schematic views of a pixel structure according to an embodiment of the present invention.
Figure 6B:
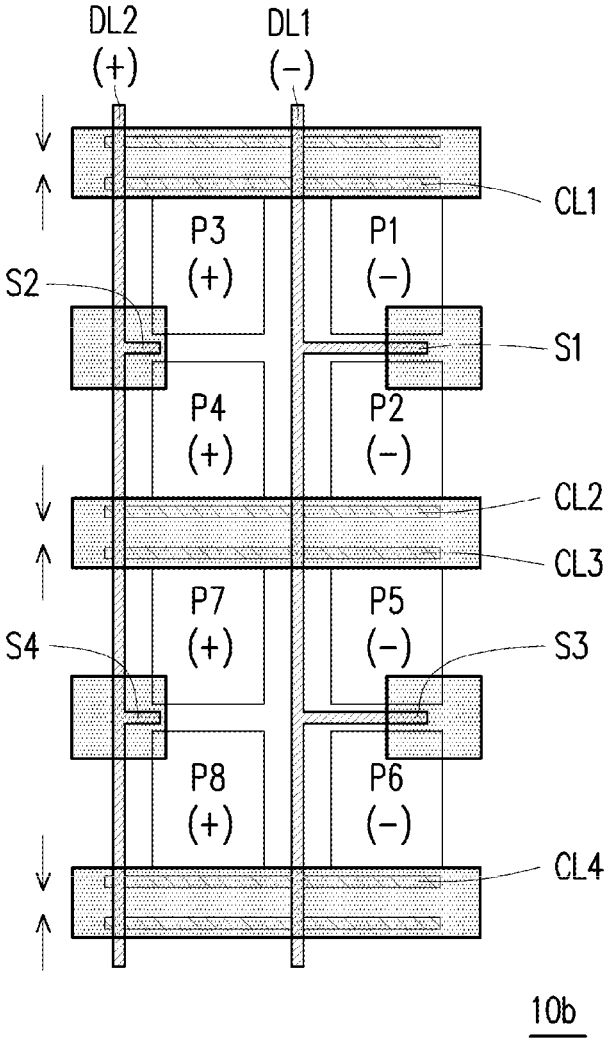
Figure 6C:
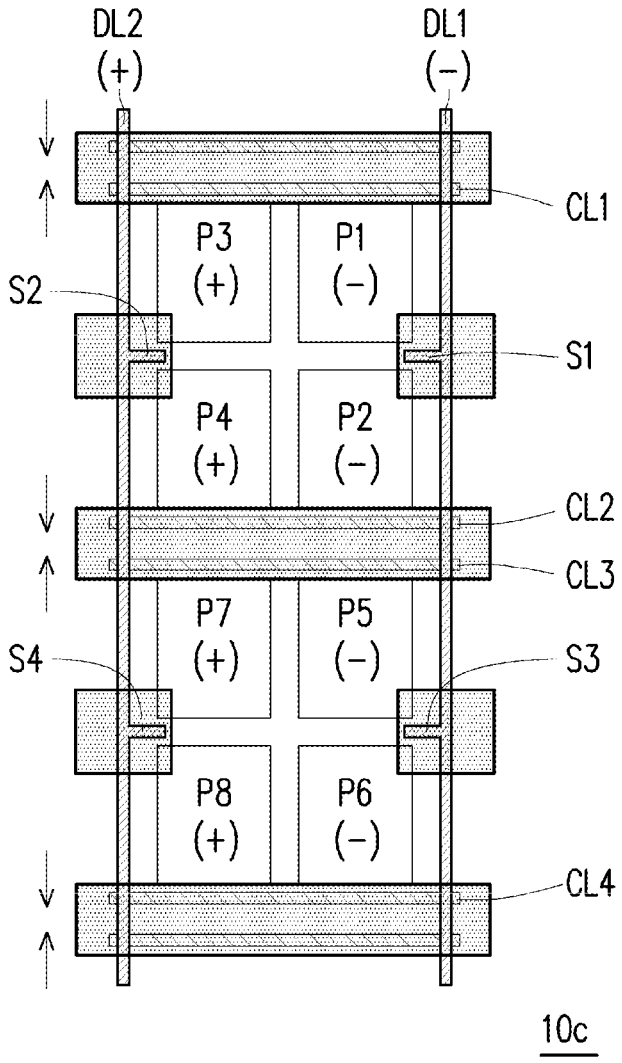
Figure 6D:
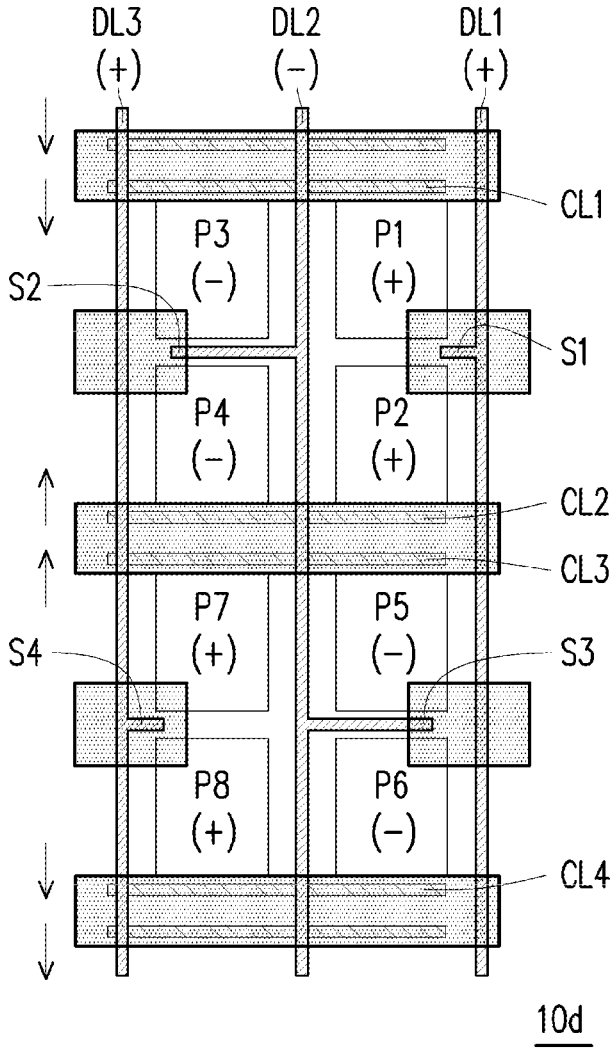
Figure 6E:
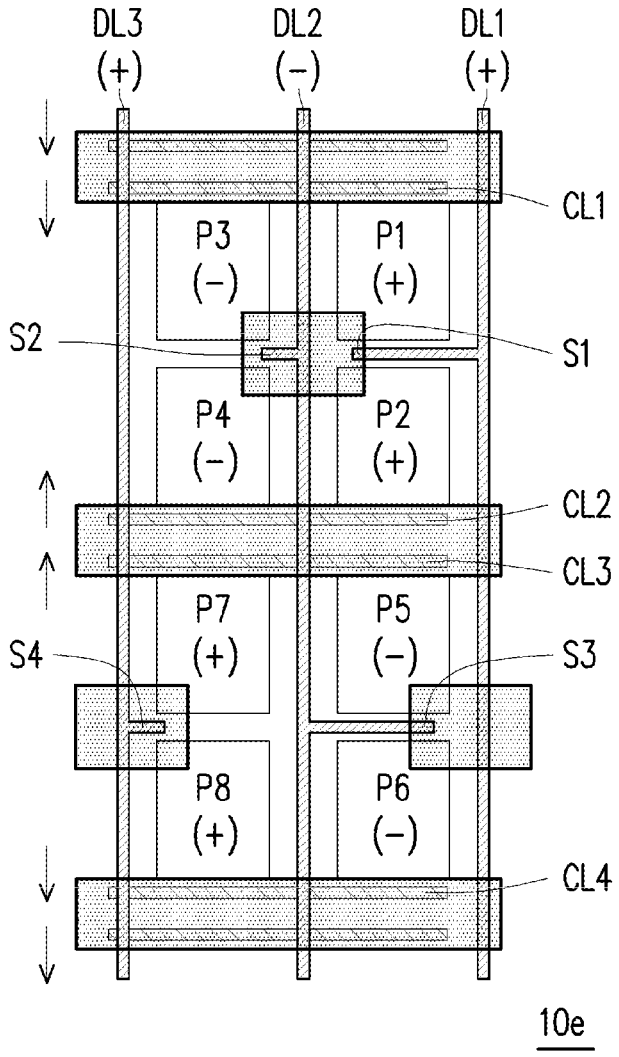
Figure 6F:
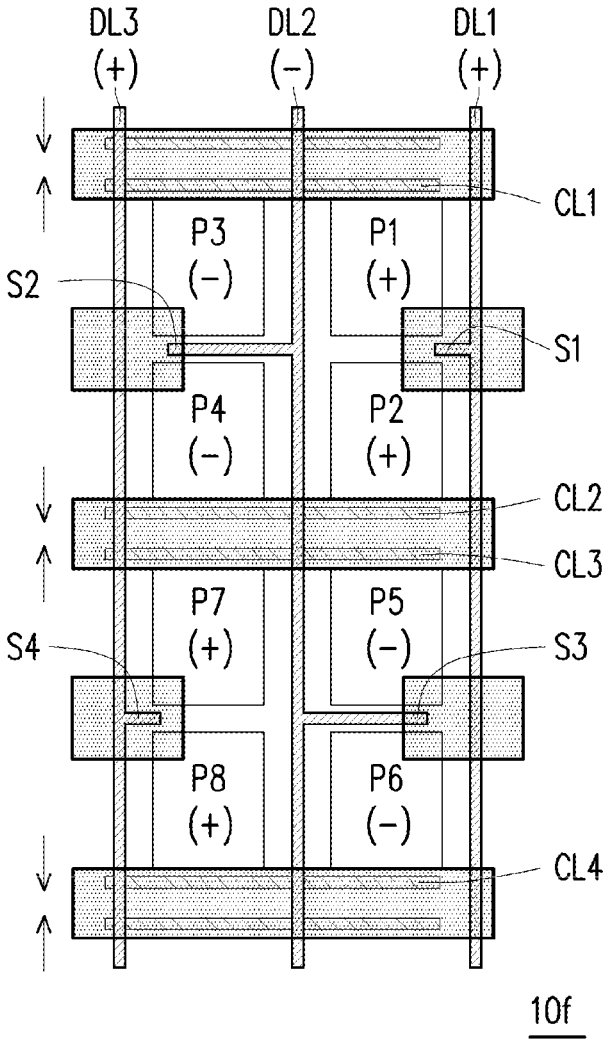
Figure 6G:
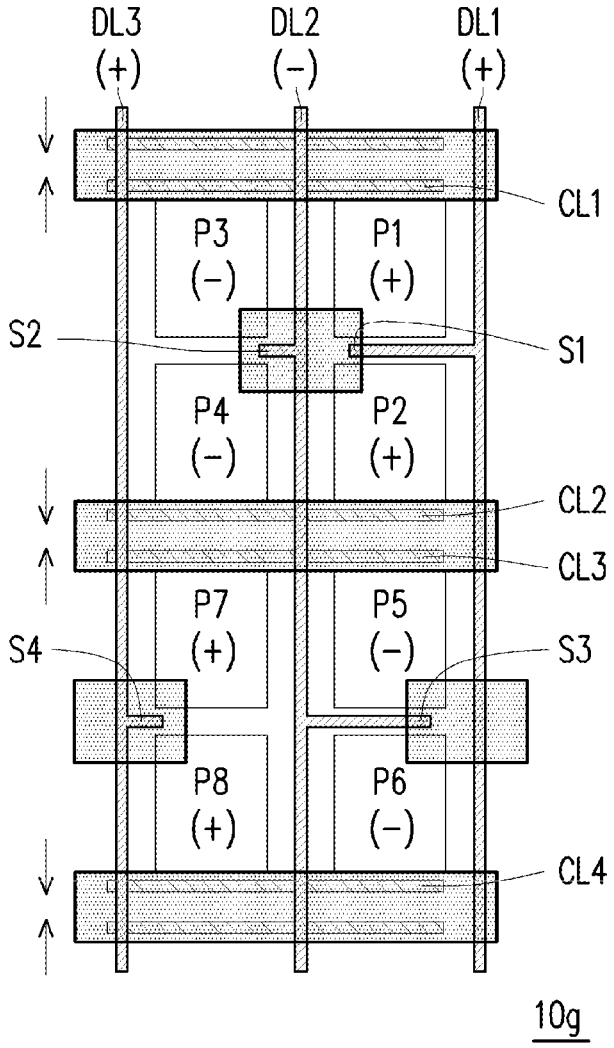
Figure 6H:
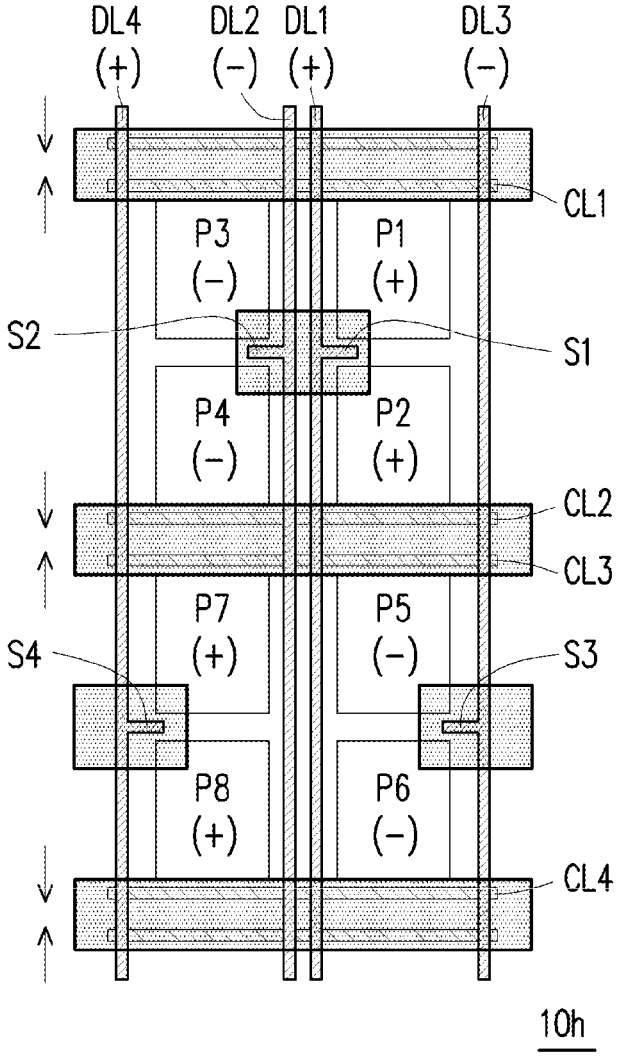
Figure 6I:
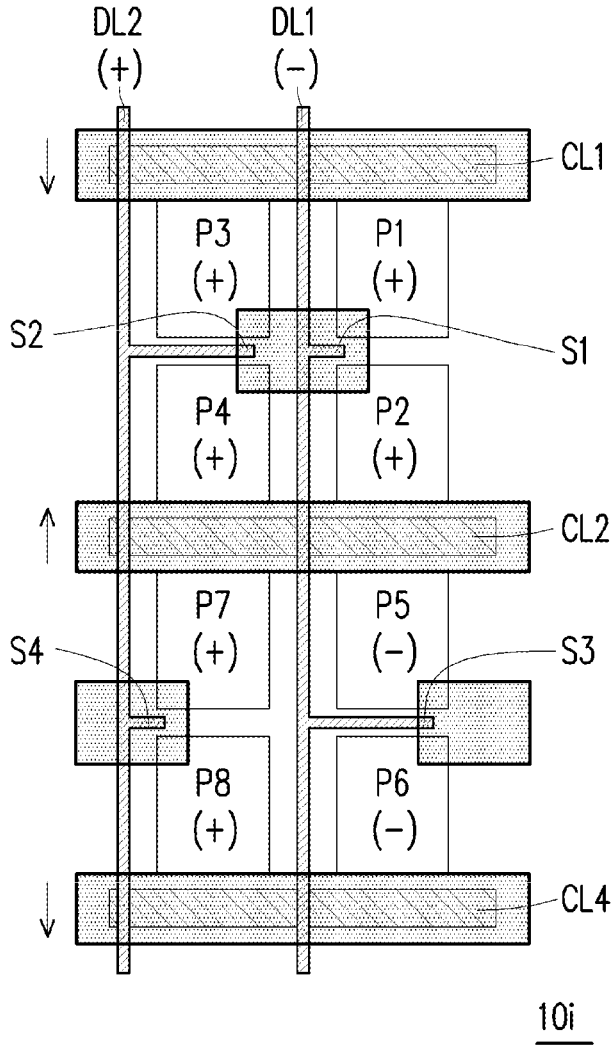
Figure 6J:
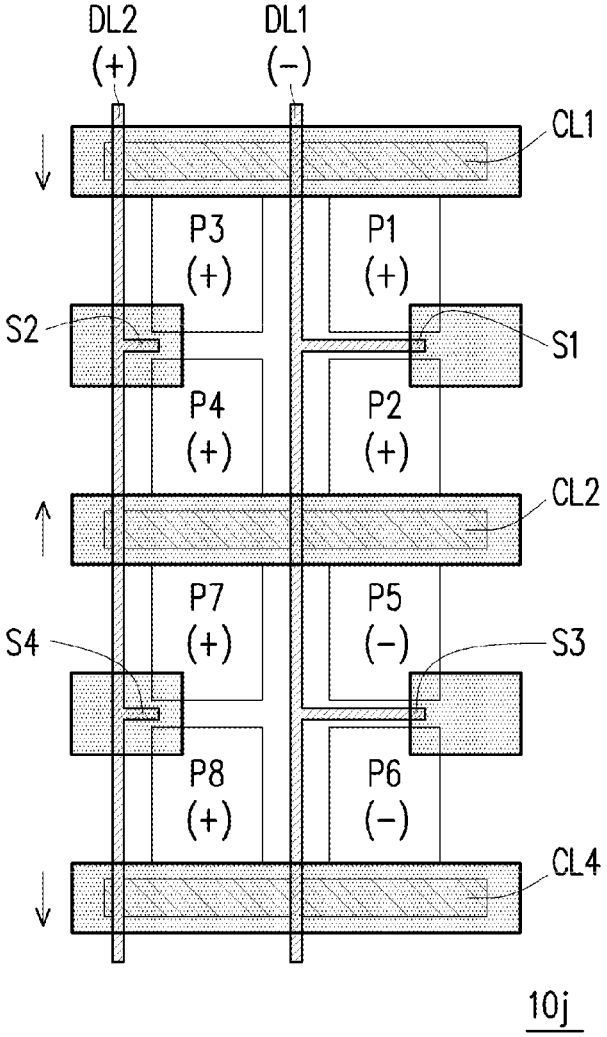
Figure 6K:
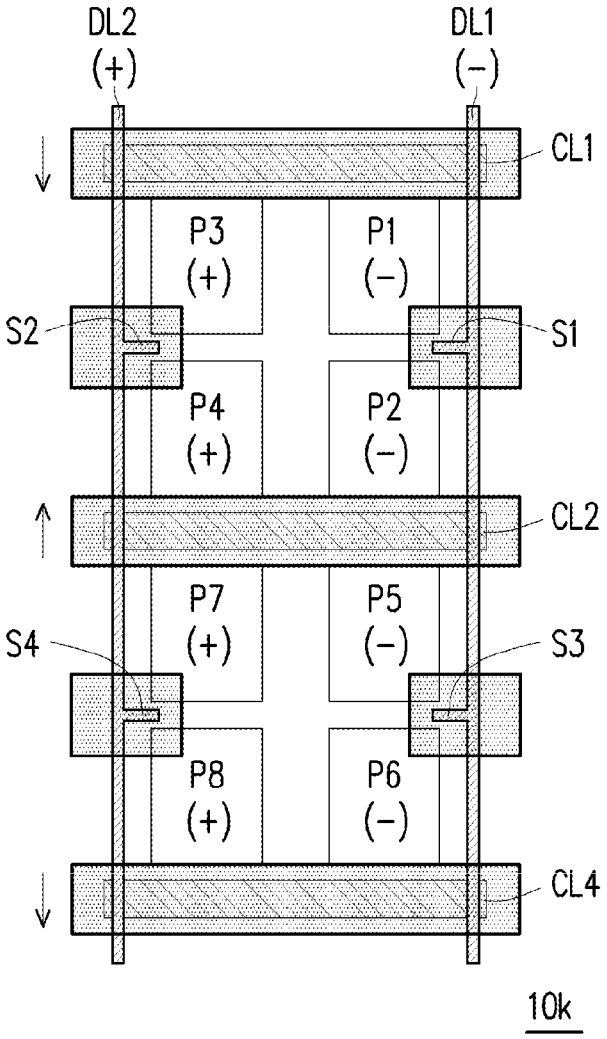
Figure 6L:
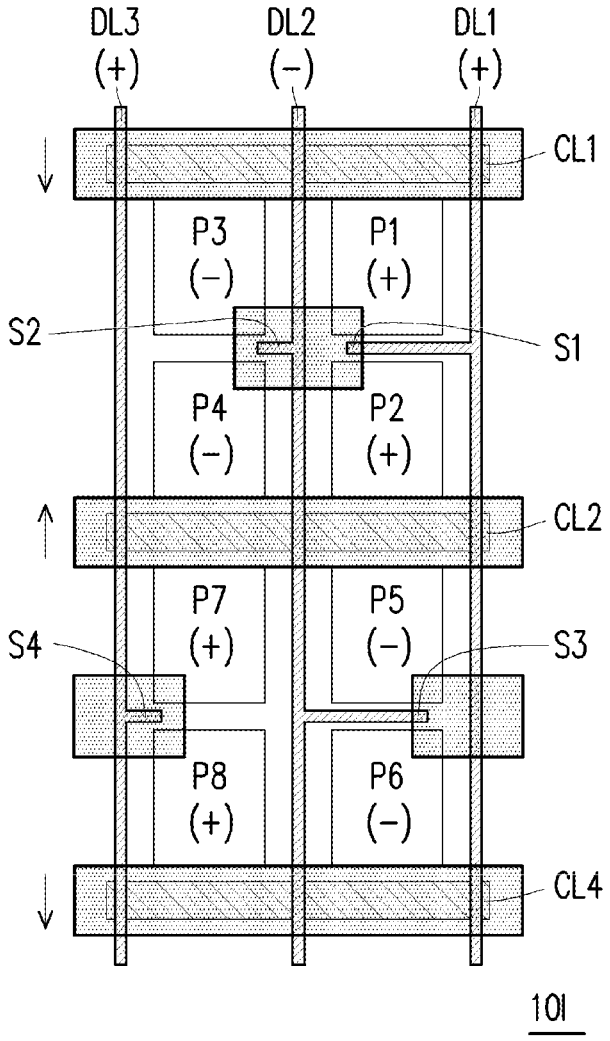
Figure 6M:
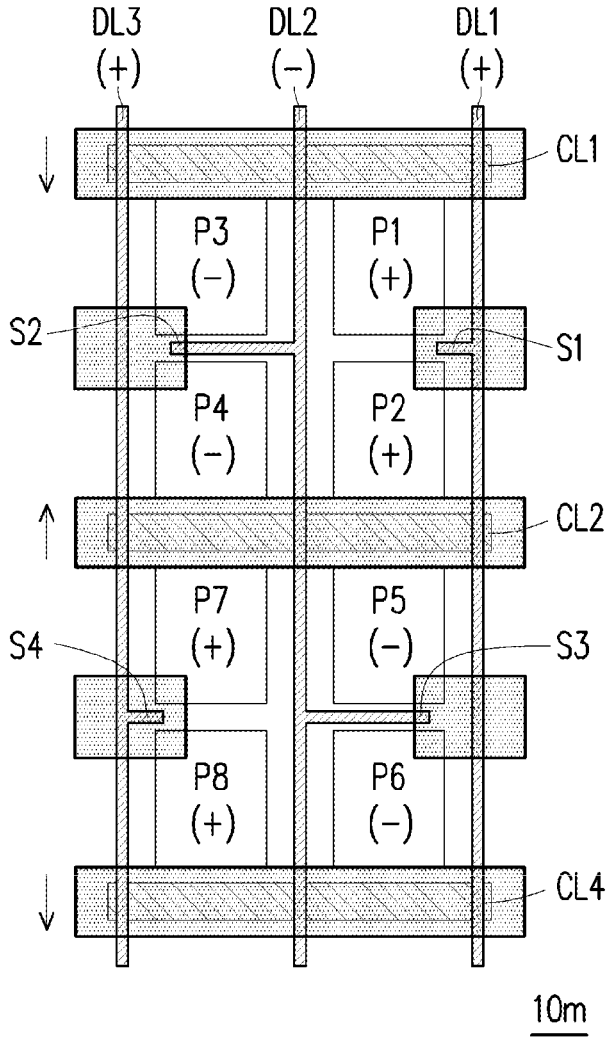
Figure 6N:
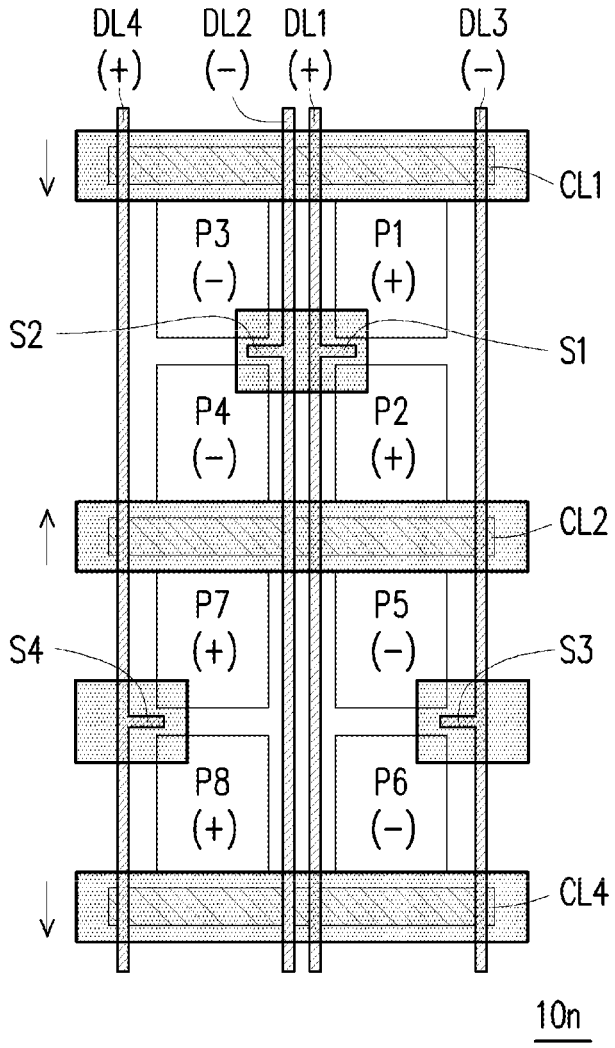

FIG. 6A to FIG. 6N are respectively schematic views of a pixel structure according to an embodiment of the present invention. In this figures, in order to clearly illustrate approximate relative positions of the shielding pattern blocks (equivalent to the positions of the openings and the trenches) and all sub-pixels as well as the driving manner of the sub-pixels, only the first to eighth sub-pixels P1-P8, the first to fourth sources S1-S4, the shielding pattern blocks 132, the scan line SL1 and SL2, the data lines DL1 and DL2, and the common lines CL1-CL4 are simply shown, an up arrow and a down arrow are used to indicate the impact of the common lines on the electric potentials of the adjacent sub-pixels, and positive (+) and negative (−) are used to indicate the polarities of the electric potentials provided by the data lines and the electric potentials of the sub-pixels coupled to the common lines, and the detailed members can be known by referring to the description in the preceding embodiments. In the pixel structure, the pixel unit is coupled to the common lines disposed at two sides thereof, and the common lines at two sides of the pixel unit have contrary impacts on the electric potentials of two sub-pixels of the pixel unit. In this way, the two sub-pixels in the pixel unit have different electric potentials, wherein the pixel having the electric potential having a larger difference as compared with the grounding electric potential is referred to as a main pixel, and the pixel having the electric potential having a smaller difference as compared with the grounding electric potential is referred to as a sub pixel. In the following illustration, the impact of the common line on the sub-pixels P1 and P2 of the first pixel unit and the impact of the sub-pixel P5 adjacent to the sub-pixel P2 are illustrated, and the impact thereof on other pixel units is omitted. With reference to FIG. 6A to FIG. 6H altogether, in the pixel structures 10*a* to 10*h*, the two adjacent pixel units on the same column do not share the same common line. With reference to FIG. 6A to FIG. 6C altogether, in the pixel structures 10*a*-10*c*, the common line CL1 is for example to increase the electric potential of the adjacent sub-pixel P1, and the common line CL2 is for example to decrease the electric potential of the adjacent sub-pixel P2. Furthermore, the two adjacent common lines CL2 and CL3 have contrary impacts on the electric potentials of the adjacent sub-pixels P2 and P5. For instance, the common line CL2 is for example to decrease the electric potential of the adjacent sub-pixel P2, and the common line CL3 is for example to increase the electric potential of the adjacent sub-pixel P5. In the pixel structures 10*a* and 10*b*, the data lines DL1 and DL2 are for example alternated with the pixel units, that is, only one column of the pixel units are arranged between two adjacent data lines DL1 and DL2, only one data line DL1 is arranged between two adjacent columns of the pixel units, wherein the pixels units on the same column are driven by the same data line DL1 or DL2. For instance, the data line DL1 drives the first and third pixel units, and the data line DL2 drives the second and fourth pixel units. In the pixel structure 10*c*, two columns of adjacent pixel units are arranged between two adjacent data lines DL1 and DL2, wherein the pixel units on the same column are driven by the same data line DL1 or DL2. For instance, the data line DL1 drives the first and third pixel units, and the data line DL2 drives the second and fourth pixel units.

With reference to FIG. 6D to FIG. 6E altogether, in the pixel structures 10*d* and 10*e*, the common line CL1 is for example to decrease the electric potential of the adjacent sub-pixel P1, and the common line CL2 is for example to increase the electric potential of the adjacent sub-pixel P2. Furthermore, the adjacent two common lines CL2 and CL3 have the same impact on the electric potentials of the adjacent sub-pixels P2 and P5. For instance, the common line CL2 and the common line CL3 are for example to increase the electric potentials of the adjacent sub-pixels P2 and P5. In the pixel structures 10*d* and 10*e*, the data lines DL1, DL2, and DL3 are for example alternated with the pixel unit, but the pixel units on the same column are driven by different data lines DL1, DL2, and DL3, that is, the same data line DL2 may drive the pixel units on two sides and on different rows. For instance, the data line DL1 drives the first pixel unit, the data line DL2 drives the second and third pixel units, and the data line DL3 drives the fourth pixel unit.

With reference to FIG. 6F to FIG. 6H altogether, in the pixel structures 10*f*-10*h*, the common line CL1 is for example to increase the electric potential of the adjacent sub-pixel P1, and the common line CL2 is for example to decrease the electric potential of the adjacent sub-pixel P2. Furthermore, the two adjacent common lines CL2 and CL3 have contrary impacts on the electric potentials of the adjacent sub-pixels P2 and P5. For instance, the common line CL2 is for example to decrease the electric potential of the adjacent sub-pixel P2, and the common line CL3 is for example to increase the electric potential of the adjacent sub-pixel P5. The driving mode of the data lines DL1 and DL2 on the pixel structures 10*f* and 10*g* is the same as the driving mode on the pixel structures 10*d* and 10*e*, thus being not repeated in detail. In the pixel structure 10*h*, the pixel units are driven by different data lines DL1 to DL4, wherein two columns of the pixel units are arranged between two data lines DL3 and DL4, two data lines DL1 and DL2 are further arranged between the two columns of the pixel units, and the data lines DL1-DL4 respectively drive the pixel units. For instance, the data line DL1 drives the first pixel unit, the data line DL2 drives the second pixel unit, the data line DL3 drives the third pixel unit, and the data line DL4 drives the fourth pixel unit.

With reference to FIG. 6I to FIG. 6N altogether, in the pixel structures 10*i*-10*n*, the two adjacent pixel units disposed on the same column share the same common line, and the common line produces the same impact on the two adjacent sub-pixels. In the pixel structures 10*i*-10*n*, the common line CL1 is for example to decrease the electric potentials of the adjacent sub-pixels P1 and P6, and the common line CL2 is for example to increase the electric potentials of the adjacent sub-pixels P2 and P5. Herein, the driving mode of the data lines DL1-DL4 on the pixel structures 10*i* and 10*n* is the same as the driving mode on the pixel structures 10*a*-10*e* and 10*h*, thus being not repeated in detail.

Figure 7:
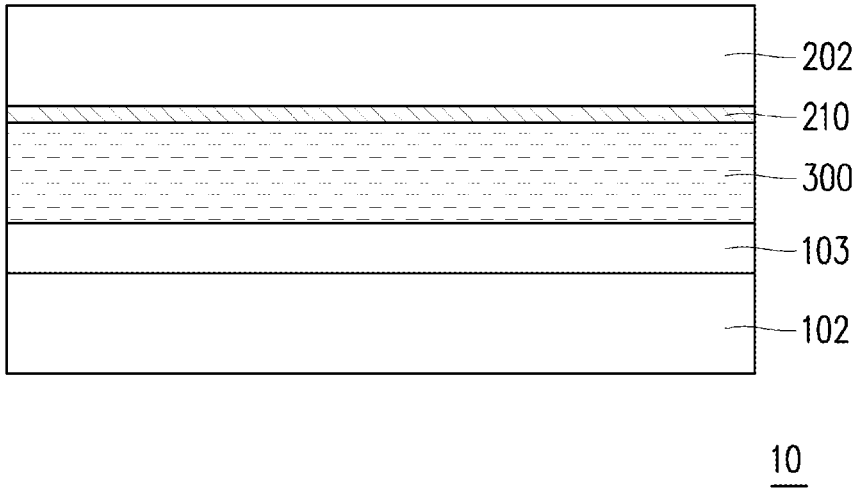
FIG. 7 is a schematic view of a pixel structure according to an embodiment of the present invention.

FIG. 7 is a schematic view of a pixel structure according to an embodiment of the present invention. In this embodiment, the pixel structure 10 includes a pixel array layer 103 arranged on a substrate 102, an opposite electrode 210 arranged on a substrate 202, and a display medium layer 300 disposed between the pixel array layer 103 and the opposite electrode 210. In this embodiment, the pixel array layer 103 includes the aforementioned first sub-pixel P1 and second sub-pixel P2, and for example includes the members arranged on the substrate 102 in FIG. 1A, FIG. 2A, FIG. 3, FIG. 5, and the like, thus being not repeated in detail. In this embodiment, the display medium layer 300 is for example arranged between the first and second pixel electrodes PE1 and PE2 and the opposite electrode 200. In this embodiment, as shown in FIG. 1A, FIG. 2A, FIG. 3, and FIG. 5, the first pixel electrode PE1 for example includes at least two alignment domains, and the second pixel electrode PE2 for example includes at least two alignment domains. In this way, a display medium layer 300 such as a liquid-crystal layer can present multi-domain alignment arrangement when being driven by the first and second pixel electrodes PE1 and PE2 so as to achieve a display effect of a broad angle of view, wherein the alignment arrangement direction of each region is controlled by an extension direction of a slot between the first and second pixel electrodes PE1 and PE2.

Based on the above, the present invention disposes the contact hole at the edge of the pixel electrode adjacent to the common line, such that two contact holes of the pixel unit are disposed at two opposite sides, and the contact holes of the pixel units on the same column may be adjacent to each other and arranged collectively. Therefore, the trenches of the color filter layer for exposing the contact holes may be connected to each other. Furthermore, the active devices of two adjacent pixel units on the same row are adjacent and arranged collectively, such that the openings of the color filter layer for exposing a part of the active devices can be connected to each other. In this way, the shielding pattern blocks filled into the openings and trenches all have a larger volume. In this way, the problem that the shielding pattern blocks are prone to strip off due to an overly small volume can be avoided, such that the pixel structure has a preferred yield. Furthermore, the shielding pattern blocks disposed at the intersecting part between the scan line and the data line can be used as spacers, so that additional process and space for arranging the spacers can be omitted, and further the aperture ratio and space utilization of the pixel structure can be improved. Therefore, the pixel structure can have a small size, thereby complying with the requirements on an increased pixel resolution. In addition, in order to avoid an unbalanced load caused by different lengths of the sources in the active device extending above the gate, an opening is formed in the gate below the source having a larger extending length, such that the pixel structure has a preferred yield.

The present invention has been disclosed above through the embodiments, but the embodiments are not intended to limit the present invention. A person of ordinary skill in the art can make some alterations and modifications without departing from the spirit and scope of the present invention.

What is claimed is:

1. A pixel structure, comprising:

a first scan line;

a first data line, intersecting with the first scan line;

a second data line, intersecting with the first scan line;

a first common line and a second common line, the first scan line being disposed between the first common line and the second common line, wherein the first common line and the second common line have different electric potentials;

a first pixel unit, comprising:

a first sub-pixel, comprising:

a first active device, electrically connected to the first scan line and the first data line; and a first pixel electrode, disposed between the first scan line and the first common line, and electrically connected to the first active device through a first contact hole, wherein the first pixel electrode includes a first side and a second side opposite to each other, the first side of the first pixel electrode is adjacent to the first scan line, and the first contact hole is disposed at an edge of the first pixel electrode adjacent to the second side of the first pixel electrode; and a second sub-pixel, comprising:

a second active device, electrically connected to the first scan line and the first data line; and a second pixel electrode, disposed between the first scan line and the second common line, and electrically connected to the second active device through a second contact hole, wherein the second pixel electrode includes a first side and a second side opposite to each other, the first side of the second pixel electrode is adjacent to the first scan line, and the second contact hole is disposed at an edge of the second pixel electrode adjacent to the second side of the second pixel electrode;

a second pixel unit, disposed on the same row as the first pixel unit, comprising:

a third sub-pixel, comprising:

a third active device, electrically connected to the first scan line and the second data line; and a third pixel electrode, disposed between the first scan line and the first common line, and electrically connected to the third active device through a third contact hole, wherein the third pixel electrode includes a first side and a second side opposite to each other, the first side of the third pixel electrode is adjacent to the first scan line, and the third contact hole is disposed at an edge of the third pixel electrode adjacent to the second side of the third pixel electrode; and a fourth sub-pixel, comprising:

a fourth active device, electrically connected to the first scan line and the second data line; and a fourth pixel electrode, disposed between the first scan line and the second common line, and electrically connected to the fourth active device through a fourth contact hole, wherein the fourth pixel electrode includes a first side and a second side opposite to each other, the first side of the fourth pixel electrode is adjacent to the first scan line, and the fourth contact hole is disposed at an edge of the fourth pixel electrode adjacent to the second side of the fourth pixel electrode;

a color filter layer, being arranged above the first pixel unit and the second pixel unit, wherein the color filter layer includes a first opening so as to not cover a part of the first active device and a part of the second active device, and includes a second opening so as to not cover a part of the third active device and a part of the fourth active device; and a shielding pattern layer, filled into the first opening and the second opening; wherein the first data line is disposed between the first pixel unit and the second pixel unit;

the first opening and the second opening are both adjacent to the first data line, and the first opening is connected to the second opening; and the first active device and the second active device share a first source, the third active device and the fourth active device share a second source, a length of the second source along a direction of the first scan line is greater than a length of the first source along the direction of the first scan line, and an overlapping part between the first scan line and the second source includes a first scan line opening.

2. The pixel structure according to claim 1, wherein the first contact hole and the third contact hole overlap with the first common line, and the second contact hole and the fourth contact hole overlap with the second common line.

3. The pixel structure according to claim 1, wherein the second pixel unit is disposed between the first data line and the second data line.

4. The pixel structure according to claim 1, wherein the third contact hole and the first contact hole are arranged in mirror relative to the first data line, the fourth contact hole and the second contact hole are arranged in mirror relative to the first data line, and a distance between the first contact hole and the first data line is less than a distance between the second contact hole and the first data line.

5. The pixel structure according to claim 1, further comprising:

a second scan line, intersecting with the first data line, wherein the second common line is disposed between the second scan line and the first scan line;

a third common line, wherein the second scan line is disposed between the second common line and the third common line, and the third common line and the second common line have different electric potentials;

a third pixel unit, disposed on the same column as the first pixel unit, comprising:

a fifth sub-pixel, comprising:

a fifth active device, electrically connected to the second scan line; and a fifth pixel electrode, disposed between the second common line and the second scan line, and electrically connected to the fifth active device through a fifth contact hole, wherein the fifth pixel electrode includes a first side and a second side opposite to each other, the first side of the fifth pixel electrode is adjacent to the second scan line, and the fifth contact hole is disposed at an edge of the fifth pixel electrode adjacent to the second side of the fifth pixel electrode; and a sixth sub-pixel, comprising:

a sixth active device, electrically connected to the second scan line; and a sixth pixel electrode, disposed between the second scan line and the third common line, and electrically connected to the sixth active device through a sixth contact hole, wherein the sixth pixel electrode includes a first side and a second side opposite to each other, the first side of the sixth pixel electrode is adjacent to the second scan line, and the sixth contact hole is disposed at an edge of the sixth pixel electrode adjacent to the second side of the sixth pixel electrode; and the color filter layer, further arranged above the third pixel unit, wherein the color filter layer includes a third opening and a trench, the third opening is corresponding to a part of the fifth active device and a part of the sixth active device, and the trench is disposed between the first pixel unit and the third pixel unit and corresponding to the second contact hole and the fifth contact hole.

6. The pixel structure according to claim 5, wherein the first contact hole and the first common line overlap with each other, the second contact hole and the fifth contact hole overlap with the second common line, and the sixth contact hole and the third common line overlap with each other.

7. The pixel structure according to claim 5, further comprising a fourth common line, and disposed between the second common line and the second scan line, wherein the third pixel unit is disposed between the fourth common line and the third common line, the first contact hole overlap the first common line, the second contact hole overlap the second common line, the fifth contact hole overlap the fourth common line, and the sixth contact hole overlap with the third common line.

8. The pixel structure according to claim 1, further comprising:

a second scan line, intersecting with the first data line and the second data line, wherein the second common line is disposed between the second scan line and the first scan line;

a third common line, wherein the second scan line is disposed between the second common line and the third common line, and the third common line and the second common line have different electric potentials;

a third pixel unit, disposed on the same column as the first pixel unit, comprising:

a fifth sub-pixel, comprising:

a fifth active device, electrically connected to the second scan line; and a fifth pixel electrode, disposed between the second common line and the second scan line, and electrically connected to the fifth active device through a fifth contact hole, wherein the fifth contact hole is disposed at an edge of the fifth pixel electrode; and a sixth sub-pixel, comprising:

a sixth active device, electrically connected to the second scan line; and a sixth pixel electrode, disposed between the second scan line and the third common line, and electrically connected to the sixth active device through a sixth contact hole, wherein the sixth pixel electrode includes a first side and a second side opposite to each other, the first side of the sixth pixel electrode is adjacent to the second scan line, and the sixth contact hole is disposed at an edge of the sixth pixel electrode adjacent to the second side of the sixth pixel electrode;

a fourth pixel unit, disposed on the same column as the second pixel unit and disposed on the same row as the third pixel unit, comprising:

a seventh sub-pixel, comprising:

a seventh active device, electrically connected to the second scan line; and a seventh pixel electrode, disposed between the second scan line and the second common line, and electrically connected to the seventh active device through a seventh contact hole, wherein the seventh contact hole is disposed at an edge of the seventh pixel electrode; and an eighth sub-pixel, comprising:

an eighth active device, electrically connected to the second scan line; and an eighth pixel electrode, disposed between the second scan line and the third common line, and electrically connected to the eighth active device through an eighth contact hole, wherein the eighth pixel electrode includes a first side and a second side opposite to each other, the first side of the eighth pixel electrode is adjacent to the second scan line, and the eighth contact hole is disposed at an edge of the eighth pixel electrode adjacent to the second side of the eighth pixel electrode; and the color filter layer, further arranged above the third pixel unit and the fourth pixel unit, wherein the color filter layer includes a third opening, a fourth opening, and a trench, the third opening is corresponding to a part of the fifth active device and a part of the sixth active device, the fourth opening is corresponding to a part of the seventh active device and a part of the eighth active device, and the second contact hole, the fourth contact hole, the fifth contact hole, and the seventh contact hole are disposed in the trench.

9. The pixel structure according to claim 8, wherein the fifth active device and the sixth active device are electrically connected to the first data line, the seventh active device and the eighth active device are electrically connected to the second data line, the second and fourth pixel units are disposed between the first data line and the second data line, the first data line is disposed between the first and second pixel units and between the third and fourth pixel units, the third active device and the fourth active device share a second source, an overlapping part between the first scan line and the second source includes a first scan line opening, the fifth active device and the sixth active device share a third source, and an overlapping part between the second scan line and the third source includes a second scan line opening.

10. The pixel structure according to claim 8, further comprising a third data line, wherein the fifth and sixth active devices are electrically connected to the second data line, and the seventh and eighth active devices are electrically connected to the third data line.

11. The pixel structure according to claim 8, wherein the first opening and the second opening are connected to each other, and the third opening is separated from the fourth opening.

12. The pixel structure according to claim 8, wherein the first contact hole and the third contact hole are arranged in mirror relative to the first data line, the second contact hole and the fourth contact hole are arranged in mirror relative to the first data line, the fifth contact hole and the seventh contact hole are arranged in mirror relative to the first data line, the sixth contact hole and the eighth contact hole are arranged in mirror relative to the first data line, a distance between the first contact hole and the third contact hole is less than a distance between the second contact hole and the fourth contact hole, and a distance between the fifth contact hole and the seventh contact hole is less than a distance between the sixth contact hole and the eighth contact hole.

13. The pixel structure according to claim 8, wherein the first contact hole and the third contact hole overlap with the first common line, the second contact hole, the fourth contact hole, the fifth contact hole, and the seventh contact hole overlap with the second common line, and the sixth contact hole and the eighth contact hole overlap with the third common line.

14. The pixel structure according to claim 8, further comprising a fourth common line, disposed between the second common line and the second scan line, wherein the third pixel unit and the fourth pixel unit are disposed between the fourth common line and the third common line, the first contact hole and the third contact hole overlap with the first common line, the second contact hole and fourth contact hole overlap with the second common line, the fifth contact hole and the seventh contact hole overlap with the fourth common line, and the sixth contact hole and the eighth contact hole overlap with the third common line.

15. The pixel structure according to claim 1, further comprising an opposite electrode and a display medium layer, wherein the display medium layer is arranged between the opposite electrode and the first, second, third and fourth pixel electrodes, and the first, second, third and fourth pixel electrodes respectively comprise at least two alignment domains.

16. The pixel structure according to claim 1, wherein the color filter layer further comprises a first trench and a second trench, the first trench exposes the first contact hole and the third contact hole, and the second trench exposes the second contact hole and the fourth contact hole.

17. The pixel structure according to claim 16, wherein the shielding pattern layer is further filled into the first trench, and the second trench.

* * * * *